US010443267B2

(12) United States Patent
Tobias et al.

(10) Patent No.: US 10,443,267 B2
(45) Date of Patent: Oct. 15, 2019

(54) LOCKSET WITH CYLINDER INTEGRITY SENSOR

(71) Applicant: Spectrum Brands, Inc., Middleton, WI (US)

(72) Inventors: Marc Tobias, Sioux Falls, SD (US); Tobias Bluzmanis, Miramar, FL (US); Mark S. Bloom, Lake Forest, CA (US); James Lin, Laguna Niguel, CA (US)

(73) Assignee: Spectrum Brands, Inc., Middleton, WI (US)

( * ) Notice: Subject to any disclaimer, the term of this patent is extended or adjusted under 35 U.S.C. 154(b) by 490 days.

(21) Appl. No.: 15/098,748

(22) Filed: Apr. 14, 2016

(65) Prior Publication Data

US 2016/0326773 A1 Nov. 10, 2016

Related U.S. Application Data

(60) Provisional application No. 62/156,511, filed on May 4, 2015.

(51) Int. Cl.
*E05B 45/06* (2006.01)
*E05B 27/00* (2006.01)
(Continued)

(52) U.S. Cl.
CPC ..... *E05B 45/06* (2013.01); *E05B 13/001* (2013.01); *E05B 27/0003* (2013.01);
(Continued)

(58) Field of Classification Search
CPC ..... E05B 45/00; E05B 45/06; E05B 45/08; E05B 45/10; E05B 2045/0635;
(Continued)

(56) References Cited

U.S. PATENT DOCUMENTS 582,711 A 5/1897 Wolfe
585,138 A 6/1897 Vandevelde
(Continued)

FOREIGN PATENT DOCUMENTS

AU 687542 B2 2/1998
AU 752233 B2 9/2002
(Continued)

OTHER PUBLICATIONS

Schlage Century Touchscreen Deadbolt Lock (BE469NX CEN619); Apr. 25, 2014.
(Continued)

*Primary Examiner* — Christopher J Boswell
(74) *Attorney, Agent, or Firm* — Merchant & Gould P.C.

(57) ABSTRACT

A lockset is provided with a sensor assembly for detecting tampering with the cylinder. A lock cylinder with a cylinder body and a cylinder plug disposed in the cylinder body is provided. The cylinder plug is configured to deform and/or separate from the cylinder body when a sufficient force is applied. A sensor assembly is provided that detects when the cylinder plug deforms and/or separates from the cylinder body. In some embodiments, the sensor assembly could detect when the cylinder plug deforms and/or separates from the cylinder body with a strain gauge, a continuity circuit, a micro-switch, an optical sensor, an accelerometer and/or a contact microphone.

43 Claims, 23 Drawing Sheets

(51) Int. Cl.
*E05B 47/06* (2006.01)
*E05B 13/00* (2006.01)

(52) U.S. Cl.
CPC ..... *E05B 47/06* (2013.01); *E05B 2045/065* (2013.01); *E05B 2045/067* (2013.01); *E05B 2045/0645* (2013.01)

(58) Field of Classification Search
CPC ..... E05B 2045/064; E05B 2045/065; E05B 2045/067; E05B 13/001; E05B 15/06; E05B 47/0001; E05B 47/06; E05B 47/0603; E05B 47/0607; E05B 2045/0645
See application file for complete search history.

(56) References Cited

U.S. PATENT DOCUMENTS 2,082,806 A * 6/1937 Michel ..... E05B 17/042 200/5 R
2,563,727 A 8/1951 Kempf
3,406,386 A 10/1968 Maddison
3,500,670 A * 3/1970 Hawkins ..... E05B 45/06 70/375
3,962,695 A * 6/1976 Peters ..... E05B 45/10 340/542
3,983,551 A 9/1976 Raymond
4,029,919 A * 6/1977 Lumme ..... E05B 45/06 200/52 R
4,186,578 A * 2/1980 Sommer ..... E05B 45/10 70/419
4,262,506 A * 4/1981 Tobel ..... E05B 45/06 70/419
4,271,691 A 6/1981 Logan
4,587,517 A 5/1986 Engstrom et al.
4,807,455 A 2/1989 Mauer
4,845,471 A 7/1989 Chu
4,953,375 A * 9/1990 Tzou ..... E05B 45/10 70/419
5,139,292 A 8/1992 Beals
5,266,923 A * 11/1993 Tseng ..... E05B 45/06 200/61.66
5,410,898 A * 5/1995 Shieh ..... B60R 25/20 70/271
5,461,360 A * 10/1995 Guim ..... B60Q 9/00 340/457
5,680,094 A * 10/1997 Guim ..... B60Q 9/00 340/332
5,686,890 A 11/1997 Ko
5,754,107 A 5/1998 Ferrantelli
5,927,112 A * 7/1999 Yamashita ..... B60R 25/02 70/252
6,105,090 A 8/2000 Fosmo
6,209,369 B1 * 4/2001 Freck ..... E05B 17/002 70/375
6,520,551 B1 2/2003 Crnkovich
7,010,947 B2 3/2006 Milo
7,290,416 B2 * 11/2007 Ohtaki ..... B60R 25/04 200/43.08
8,490,445 B2 7/2013 Chiou et al.
8,803,689 B2 8/2014 Berger
9,206,620 B2 * 12/2015 Karsil ..... E05B 45/06
9,394,723 B1 * 7/2016 Roth ..... E05B 27/006
9,574,375 B2 * 2/2017 Henderson ..... E05B 47/0001
2012/0192604 A1 8/2012 Simmering

FOREIGN PATENT DOCUMENTS

AU 2011284787 A1 3/2013
CA 1155470 A1 10/1983
CA 2121970 A1 1/1995
EP 2058460 B9 3/2012
GB 1215010 A 12/1970
GB 2286423 A 8/1995
JP 2004044099 A 2/2004
JP 2008-174991 7/2008
JP 2009-167632 7/2009
KR 2008082838 A 9/2008
WO WO 03-002213 1/2003
WO WO 2007-003920 1/2007

OTHER PUBLICATIONS

Securitech Sample Model Detail Flyer Automatic Deadbolt Multi-Point Exit Device With Internal Vertical Deadbolts & 95db Battery Operated Alarm (Undated).
Physical Security Handbook 440-2-H Chapter 5. Interior Protection (Aug. 2005).
International Search Report dated Aug. 19, 2016; International Application No. PCT/US2016/029286.

* cited by examiner

LOCKSET WITH CYLINDER INTEGRITY SENSOR

RELATED APPLICATIONS

This application claims priority to U.S. Provisional Application Ser. No. 62/156,511 filed May 4, 2015, which is hereby incorporated by reference in its entirety.

TECHNICAL FIELD

This disclosure relates generally to electromechanical locks; in particular, this disclosure relates to a lock with a sensor that detects tampering (or other manipulation) of the lock's cylinder.

BACKGROUND AND SUMMARY

Locksets are susceptible to various types of attacks. In many attacks, manipulation of the cylinder plug is critical to overcoming the lock. However, it is generally difficult to know whether the integrity of the cylinder has been compromised by an attack unless the lock is marred by forced entry. Even in situations with forced entry, there may be no visible indication that the cylinder has been compromised. Therefore, there is a need for a device that monitors integrity of lock cylinders.

According to one aspect, this disclosure provides a lock cylinder with a cylinder body and a cylinder plug disposed in the cylinder body. The cylinder plug includes a portion configured to deform and/or separate from the cylinder body when a sufficient force is applied to the cylinder plug. A sensor assembly is provided that detects when at least a portion of the cylinder body deforms and/or separates from the cylinder body. One skilled in the art should appreciate that numerous sensors could be used to detect separation of the cylinder plug with respect to the cylinder body and this disclosure is not intended to be limited to the example sensors described herein. By way of example only, the sensor assembly could detect when the cylinder plug deforms and/or separates from the cylinder plug with a strain gauge, a continuity circuit, a micro-switch, an optical sensor, accelerometer and/or a contact microphone. In some embodiments, the sensor assembly could include an opening dimensioned to receive the cylinder plug. For example, the sensor assembly could include a raised edge surrounding the opening. Depending on the circumstances, one or more sensors could be in the raised edged edge. In some cases, the opening in the sensor assembly may be coaxial with an opening in the cylinder body that receives the cylinder plug.

According to another aspect, this disclosure provides a lock cylinder with a cylinder body and a cylinder plug disposed in the cylinder body. The cylinder plug includes a portion configured to deform and/or separate from the cylinder body when a sufficient force is applied. The lock cylinder includes means for detecting when the cylinder plug deforms and/or separates from the cylinder body. Depending upon the circumstances, the means for detecting when at least a portion of the cylinder plug deforms and/or separates from the cylinder body could be one or more of a strain gauge, a continuity circuit, a micro-switch, an optical sensor, accelerometer and/or a contact microphone.

In yet another aspect, this disclosure provides a lockset with an exterior assembly and interior assembly. The exterior assembly includes a cylinder body and cylinder plug disposed in the cylinder body. The cylinder plug includes a portion configured to deform and/or separate from the cylinder body when a sufficient force is applied. The exterior assembly includes a sensor assembly configured to detect when the cylinder plug deforms and/or separates from the cylinder body. The interior assembly includes an interior driver operatively coupled to the cylinder plug with a torque blade extending therebetween. A circuit is electrically connected to the sensor assembly and controls movement of the interior driver. The interior assembly also includes a tamper lock operative to restrict movement of the interior driver. The circuit actuates the tamper lock responsive to detection by the sensor assembly that at least a portion of the cylinder plug has deformed and/or separated from the cylinder body. In some cases, the circuit signals an alarm responsive to detection by the sensor assembly that at least a portion of the cylinder plug has deformed and/or separated from the cylinder body. For example, the circuit could actuate an audible alarm with a speaker responsive to detection by the sensor assembly that at least a portion of the cylinder plug has deformed and/or separated from the cylinder body. In some embodiments, the circuit is configured to transmit a wireless message indicating that the sensor assembly has detected deformation and/or separation of the cylinder plug. Depending on the circumstances, the tamper lock could include a solenoid with a bolt movable between an extended and retracted position based on control by the circuit. In some cases, the bolt of the solenoid limits movement of the interior driver when the bolt is in the extended position.

In a further aspect, this disclosure provides a method of detecting tampering with a lock cylinder. The method includes the steps of providing a cylinder body and a cylinder plug disposed in the cylinder body. The cylinder plug includes a portion configured to deform and/or separate from the cylinder body when a sufficient force is applied. The method also includes the step of monitoring the cylinder plug to detect when at least a portion of the cylinder plug deforms and/or separates from the cylinder body. If the cylinder plug deforms and/or separates from the cylinder body, an electrical signal is generated indicating tampering of the cylinder plug. In some cases, an audible alarm is generated responsive to detection that at least a portion of the cylinder plug has deformed and/or separated from the cylinder body. Embodiments are contemplated in which a tamper lock that locks the cylinder plug is actuated responsive to detection that at least a portion of the cylinder plug has deformed and/or separated from the cylinder body.

Additional features and advantages of the disclosure will become apparent to those skilled in the art upon consideration of the following detailed descriptions exemplifying the best mode of carrying out the disclosure as presently perceived.

BRIEF DESCRIPTION OF THE DRAWINGS

The present disclosure will be described hereafter with reference to the attached drawings which are given as non-limiting examples only, in which.

Figure 1:
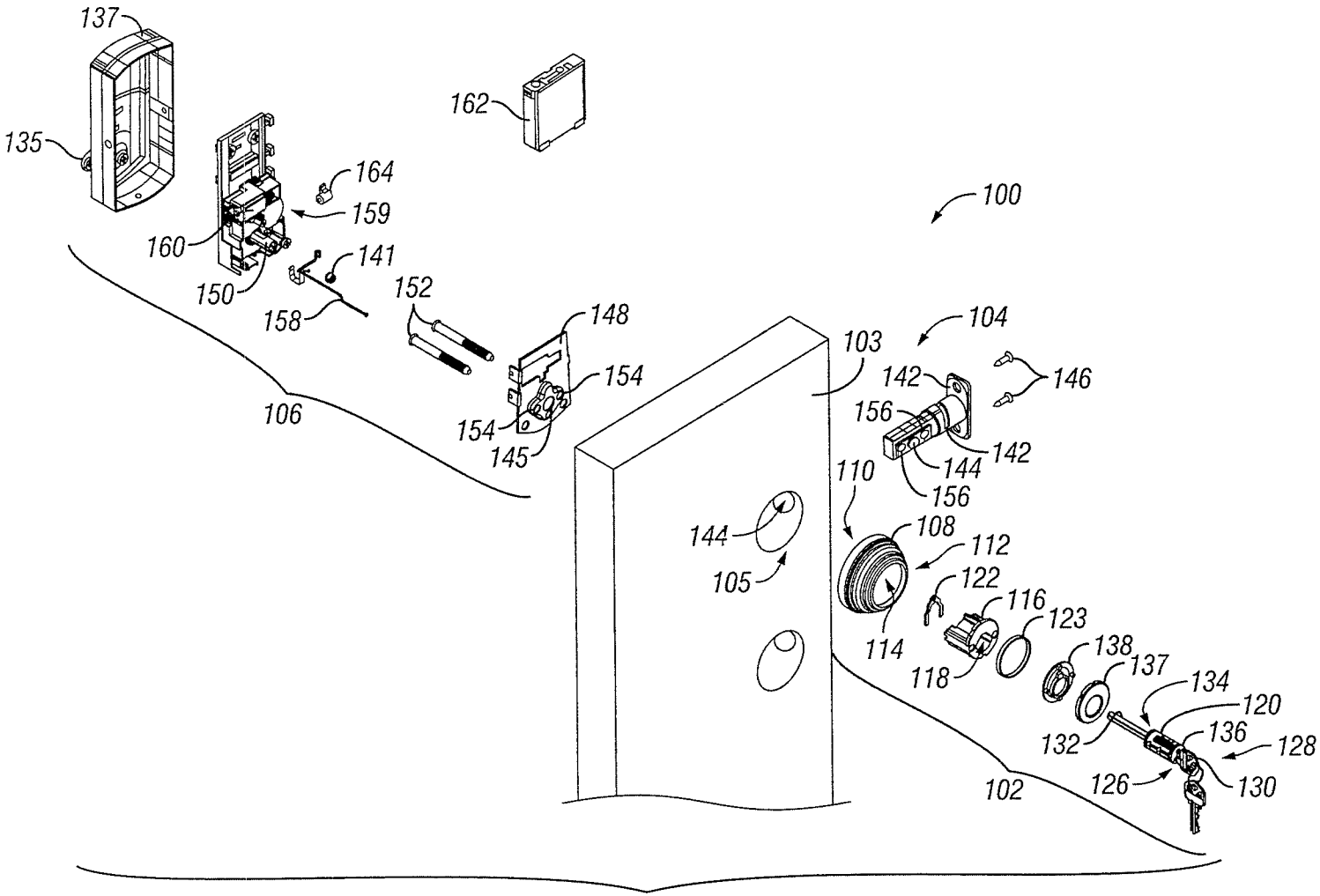
FIG. 1 is an exploded view of an example lock assembly according to an embodiment of this disclosure.

Corresponding reference characters indicate corresponding parts throughout the several views. The components in the figures are not necessarily to scale, emphasis instead being placed upon illustrating the principles of the invention. The exemplification set out herein illustrates embodiments of the invention, and such exemplification is not to be construed as limiting the scope of the invention in any manner.

DETAILED DESCRIPTION OF THE DRAWINGS

This disclosure generally relates to an electromechanical lock with certain features. The term "electromechanical lock" is broadly intended to include any type of lockset that uses electrical power in some manner, such as for controlled access, but also has a mechanical portion that can be actuated with a mechanical key, including but not limited to electronic deadbolts, electronic lever sets, etc. This disclosure encompasses the integration of one or more features described herein into any type of electromechanical lock and is not intended to be limited to any particular type of electromechanical lock.

FIG. 1 shows an example lock assembly 100 according to one embodiment of the disclosure. In the example shown, the lock assembly 100 includes an exterior assembly 102, a latch assembly 104, and an interior assembly 106. Typically, the exterior assembly 102 is mounted on the outside of a door 103, while the interior assembly 106 is mounted inside the door 103. The latch assembly 104 is typically mounted in a bore 105 formed in the door 103. The term "exterior" is broadly used to mean an area outside a door and "interior" is also broadly used to denote an area inside a door. With an exterior entry door, for example, the exterior assembly 102 may be mounted outside a building, while the interior assembly 106 may be mounted inside the building. With an interior door, the exterior assembly 102 may be mounted inside a building, but outside a room secured by the lock assembly 100; the interior assembly 106 may be mounted inside the secured room. The lock assembly 100 is applicable to both interior and exterior doors.

In the example shown, the exterior assembly 102 is in the form of a deadbolt. As discussed above, however, this disclosure is not intended to be limited to only an electromechanical deadbolt, but encompasses any kind of electromechanical lock. As shown, the exterior assembly 102 includes a cylinder guard 108 that houses internal components of the exterior assembly 102. In the example shown, the cylinder guard 108 has a decorative external surface shape with a rear portion 110 that would be adjacent the door 103 and a front portion 112 extending from the door 103. In this example, the cylinder guard 108 has a tapered shape from the rear portion 110 to the front portion 112, but the exterior assembly 102 and cylinder guard 108 could have a wide variety of different sizes and shapes depending on the particular circumstances.

In the embodiment shown, the cylinder guard 108 includes an opening 114 dimensioned to receive a cylinder body 116. The cylinder body 116 includes an opening 118 dimensioned to receive a cylinder plug 120. In the embodiment shown, the cylinder plug 120 is attached to the cylinder body 116 using a clip 122. A seal 123, such as an O-ring, surrounds the cylinder body 116 for weatherproofing the exterior assembly 102, which may be exposed to the elements.

The cylinder plug 120 includes a front end with a plug face 126 defining a keyway 128 into which a key 130 can be inserted into the cylinder plug 120. A torque blade 132 extends from a rear end 134 of the cylinder plug 120. The torque blade 132 rotates with the cylinder plug 120 to actuate the latch assembly 104 if an authorized key is inserted and rotated in the cylinder plug 120. As discussed below, the torque blade 132 may also be actuated with a turn piece 135 in the interior assembly 106 to lock/unlock the latch assembly 104 from the interior of the door 103 using the turn piece 135. The cylinder body 116 and cylinder plug 120 cooperate to prevent rotation of the cylinder plug 120 relative to the cylinder body 116 unless an authorized key is inserted into a keyway 128 of the cylinder plug 120 (or the lock assembly 100 is otherwise unlocked electronically).

The cylinder plug 120 includes at least a portion that is configured to deform and/or separate from the cylinder body 116 when an excess amount of force is applied to the cylinder plug 120 (or someone otherwise attempts to manipulate the cylinder plug). For example, the cylinder plug could include a cover 136 attached to the face 126 of the cylinder plug 120 (or could be integrated into the front of the cylinder plug 120) that is configured to deform and/or separate if excess torque is applied to the cylinder plug. As shown, the cover 136 includes a keyway coaxial with the keyway 128 of the cylinder plug 120, but includes a frangible material that deforms and/or separates if excess torque is applied to the cover (or someone otherwise attempts to manipulate the cover 136). One skilled in the art should appreciate that numerous types of materials, such as plastics and other frangible materials, could be used for the cylinder plug 120 that deform and/or separate the cover 136 (or some other portion of the cylinder plug 120) from the cylinder body 116 if excess torque is applied, but would not deform or separate when an authorized key is used to actuate the lock assembly 100. In some cases, the cover 136 could be formed from a material that fragments (e.g., disintegrates) when excess torque is applied to it. For example, if excess torque is applied to the cover 136 with a screwdriver (or other forced-entry tool) in an attempt to force movement of the cylinder plug 120 with respect to the cylinder body 116, the cover 136 will deform and/or separate (e.g., break away, disfigure or fracture). A lock assembly that includes this type of cover is currently sold under the name Kevo™ by Spectrum Brands, Inc. of Middleton, Wis.

A sensor assembly 138 detects whether tampering has occurred with the lock assembly 100 based on the deformation and/or separation of the cylinder plug 120. By way of example only, the sensor assembly 138 could detect tampering by detecting an excess amount of torque loaded on the cylinder plug 120 with a strain gauge, a continuity circuit, an optical sensor, accelerometer, a contact microphone and/or microswitch. In some embodiments, the sensor assembly 138 is disposed between a cover 137 and the cylinder body 116. However, one skilled in the art should appreciate that numerous sensors and techniques could be used to detect tampering with the cylinder plug 120 and Applicant does not intend for this disclosure to be limited to these specific embodiments.

In some embodiments, detection of tampering by the sensor assembly 138 will actuate an alarm, such as by a speaker 141; however, this disclosure is not intended to be limited to an audible alarm, but could be a visual alarm (e.g., flashing light on exterior assembly 102 and/or interior assembly 106 and/or both). If lock assembly 100 is equipped with wireless communication hardware, a wireless communication could be transmitted upon detection of tampering by the sensor assembly 138 that indicates tampering with the lock assembly 100, such as using any of WiFi, Zigbee™ and/or Z-Wave™ communication protocols.

Depending on the circumstances, the lock assembly 100 could include a tamper lock 164 that automatically locks the lock assembly 100 responsive to detection of tampering by the sensor assembly 138. In some embodiments, the tamper lock 164 could interfere with rotation of the interior driver 150, which would prevent unlocking of the lock assembly 100 (or otherwise make lock assembly 100 inoperable). In this manner, attempts to manipulate the lock assembly 100 through forced entry would be detected by the sensor assembly 138 and result in automatic actuation of the tamper lock 164, thereby thwarting the attack.

The latch assembly 104 is disposed in the bore 105 in the door 103 and may be actuated by the torque blade 132 to extend/retract a bolt 140 (FIGS. 10, 14, 18, and 22). The bolt 140 moves linearly in and out of a sleeve 142. When the bolt 140 is retracted, an end of the bolt 140 is generally flush with a base plate 142 (See also FIGS. 10, 14, 18 and 22). When the bolt 140 is extended, the bolt 124 protrudes through an edge bore 144 in the door 103 into an opening of a strike plate (not shown), which is positioned in a jamb adjacent the door 103. As is typical, fasteners 146 attach the base plate 142 of the latch assembly 104 to the door 103.

In the embodiment shown, the latch assembly 104 includes a cam 144 that is drivable in a first direction to extend the bolt 140 and a second direction to retract the bolt 140. The cam 144 is configured to receive the torque blade 132 such that rotation of the torque blade 132 in a first direction retracts the bolt 140; whereas, rotation of the torque blade 132 in the opposite direction causes the cam 144 to retract the bolt 140.

In some embodiments, the torque blade 132 extends through the latch assembly 104 into an opening 145 in a mounting plate 148, which is attached to an interior side of the door 103. The torque blade 132 passes through the opening 145 and is received by an interior driver 150, which is connected to the turn piece 135 disposed in an interior cover 137. Since the torque blade 132 is disposed within the cam 144, rotation of the interior driver 150 (from the user rotating the turn piece 135) may be used to extend and/or retract the bolt 140. In the embodiment shown, fasteners 152 extend through holes 154 in the mounting plate 148, which are aligned with openings 156 in the latch assembly 104. A wiring harness 158 electrically connects electronics between the exterior assembly 102 and the interior assembly 106.

The interior assembly 106 and exterior assembly 102 typically include electronics for electronic access control. For example, the exterior assembly of some electromechanical locks includes a keypad (not shown) for entering a pin code, which is electrically connected to circuitry 159 in the interior assembly 106 that determines whether the pin code entered by the user is authorized and, if so, actuates a motor 160 to rotate the torque blade 132, which unlocks the lock assembly 100. U.S. Pub. No. 2014/0250956 A1 filed Feb. 25, 2014 entitled "Electronic Deadbolt" is an example of an electromechanical lock with a keypad in some embodiments and is hereby incorporated by reference. In some cases, such as FIG. 1, electromechanical locks will not include a keypad, but may receive a wireless communication of an access code. U.S. Pub. No. 2014/0260449 A1 filed Mar. 10, 2014 entitled "Wireless Lockset with Integrated Antenna, Touch Activation, and Light Communication Method" is an example of an electromechanical lock with wireless communication and is hereby incorporated by reference. The circuitry (and other electronic components) are typically powered by a battery pack 162.

Figure 2:
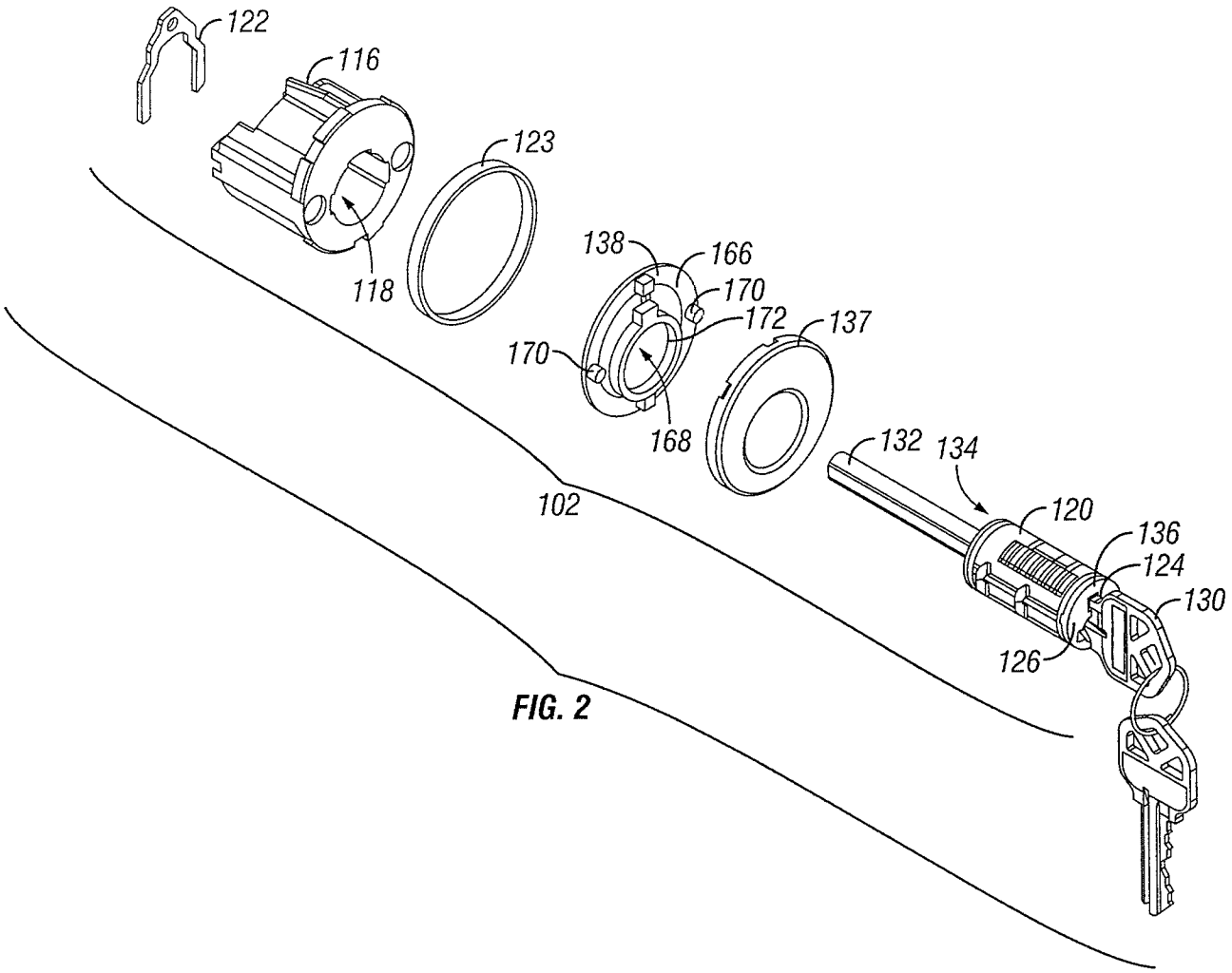
FIG. 2 is a partial exploded view of an example exterior assembly according to an embodiment of this disclosure.

FIG. 2 is an exploded view of the exterior assembly 102 (without the cylinder guard 108). From this view, the cover 136 on the front end of the cylinder plug 120 can be seen. As discussed above, the cover 136 is configured to deform and/or separate from the cylinder plug and/or fracture if excess torque is applied to the cover (and/or other manipulation of the cover if an attempted forced entry is made). The sensor assembly 138 is configured to detect tampering with the cover 136. In the embodiment shown, the sensor assembly 138 includes a base 166 defining an opening 168 dimensioned to receive the cylinder plug 120. In this example, the base 166 is circular in shape with a diameter corresponding with a face of the cylinder body 116. When assembled, the opening 168 in the sensor assembly 138 is aligned with the opening 118 in the cylinder body 116 (See FIG. 3B). In the embodiment shown, the sensor assembly 138 includes one or more spacers 170 extending from the base portion 166. As shown, the sensor assembly 138 includes a raised edge 172 surrounding the opening 168. In some cases, one or more sensors may be disposed in the raised edge 172 to detect tampering with the cover 136. When assembled, the raised edge 172 would typically surround the cover 136 (See FIG. 3C). For example, the raised edge 172 could be coaxial with the cover 136 along an axis substantially transverse to the keyway axis (the axis along which the key travels when inserted into the keyway 124). In some cases, the raised edge 172 would have a thickness substantially the same as the cover 136.

Figure 3B:
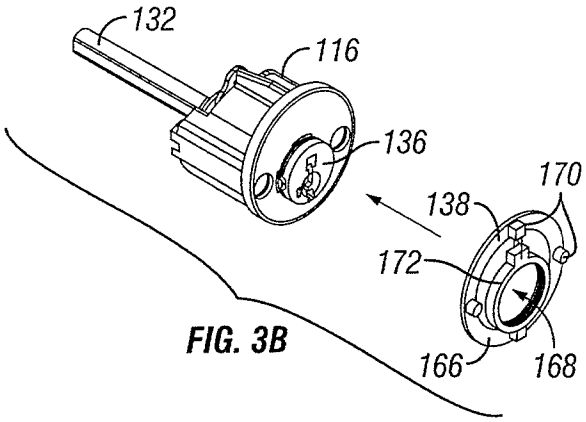
FIGS. 3A-3D show a progression of exploded views showing assembly of the example exterior assembly shown in FIG. 2.
Figure 3D:
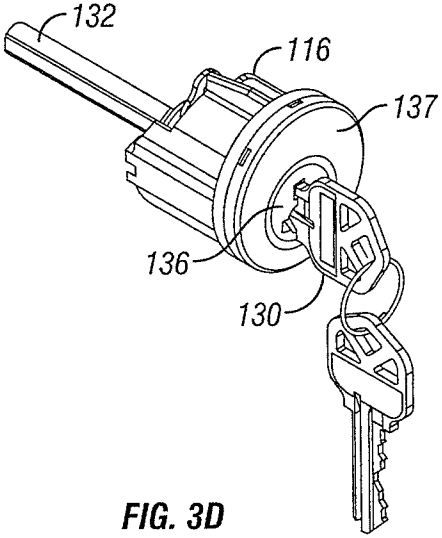
Figure 3A:
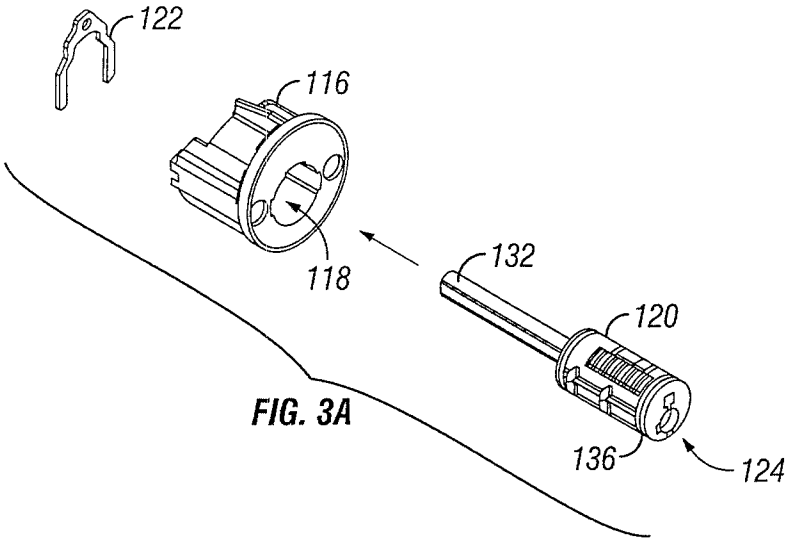
Figure 3C:
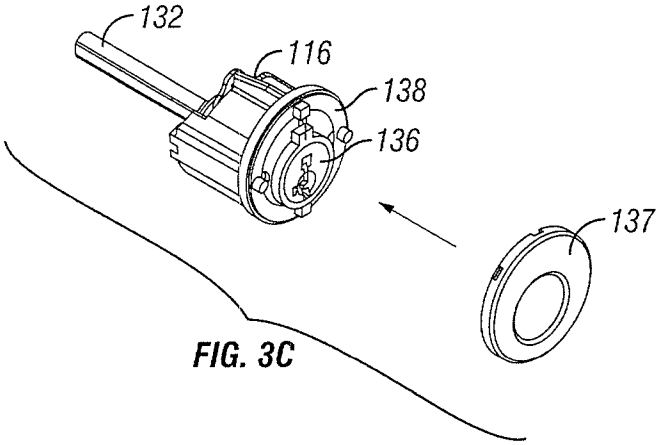

FIGS. 3A-3D show a progression in which a portion of the exterior assembly 102 is being assembled according to one embodiment. In FIG. 3A, the cylinder plug 120 is to be inserted into the opening 118 in the cylinder body 116 and secured in place with the clip 122. FIG. 3B shows that the opening 168 in the sensor assembly 138 is received by the cover 136 of the cylinder plug 120. FIG. 3C shows that the cover 137 is fitted onto the cylinder body 116. FIG. 3D shows an authorized key 130 inserted into the keyway of the cylinder plug 120.

Figure 4:
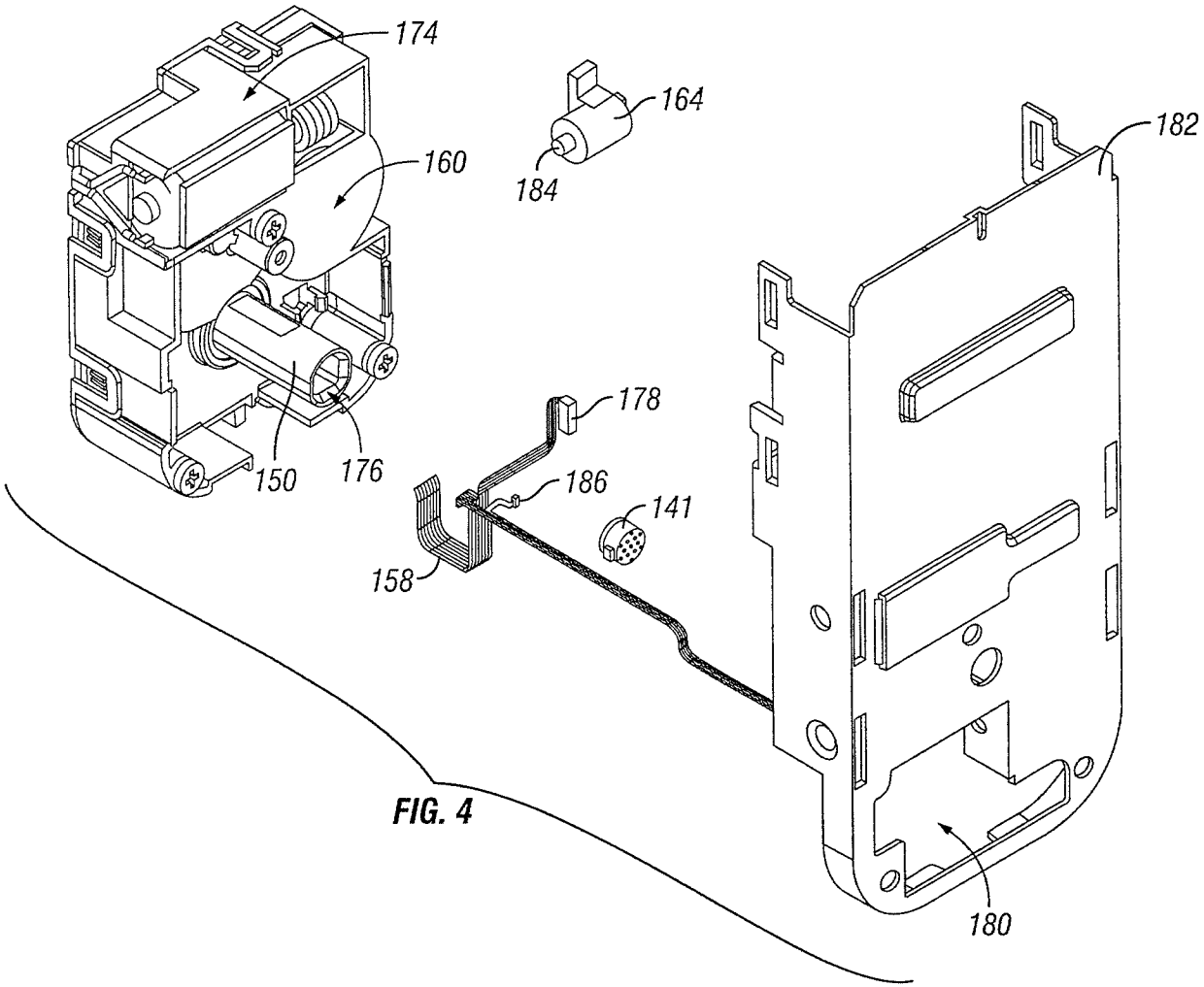
FIG. 4 is a partial exploded view of an example interior assembly according to an embodiment of this disclosure.

In FIG. 4, a portion of the interior assembly 106 is shown. In the embodiment shown, the interior assembly 106 includes a transmission box 174 in which a motor 160 and gearing (not shown) are disposed. The motor 160 drives the interior driver 150, which receives the torque blade 132 in an opening 176. With this arrangement, the motor 160 is able to drive the bolt 140 between extended and retracted positions to lock and unlock the lock assembly 100. An opposed site of the interior driver 150 is connected with the turnpiece 135 for the user to manually actuate the bolt 140. As discussed above, the motor 160 is controlled by the circuit 159 (FIG. 1), which actuates the motor 160 responsive to input from the user, such as entering a pin via a keypad and/or wireless communication. In the embodiment shown, the wiring harness 158 extends through an opening 180 in the back plate 182 to connect electronics in the exterior assembly 102 with the circuit 159 (FIG. 1). For example, the wiring harness 158 could electrically connect the circuit 159 with the sensor assembly 138.

As shown, the wiring harness includes a first terminal 178 to be connected with the tamper lock 164. In some embodiments, for example, the tamper lock 164 could be electronically controlled by the circuit 159 to lock responsive to a signal from the sensor assembly 138 of tampering. For example, the tamper lock 164 could be a solenoid with a bolt 184 that moves between an extended position and a retracted position. In the extended position, the bolt 184 is received in an opening in the interior driver 150 to block rotation of the interior driver 150, which locks the locking assembly 100. In the retracted position, the bolt 184 is out of the opening and therefore does not restrict rotation of the interior driver 150. In the embodiment shown, the wiring harness 158 includes a second terminal 186 to be connected to the speaker 141. As discussed above, the circuit 159 could sound an audible alarm with the speaker 141 responsive to detection by the sensor assembly 138 of tampering. The transmission box 174 is to be attached with a back plate 182.

Figure 5A:
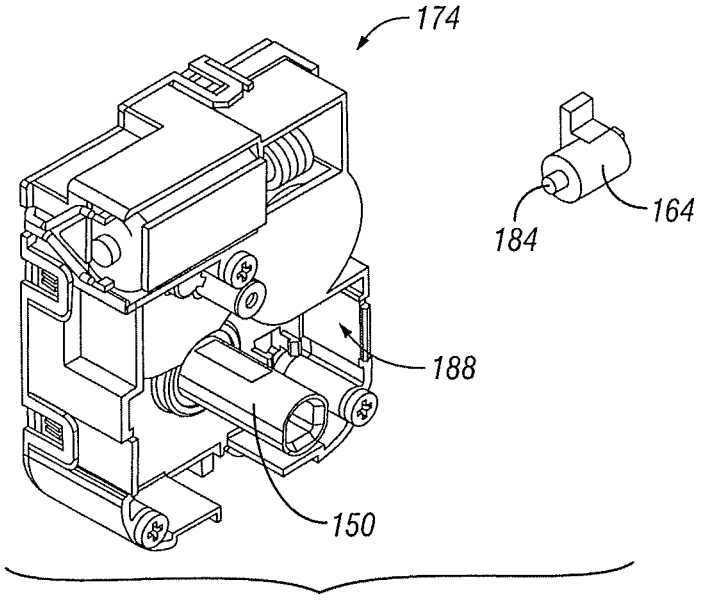
FIGS. 5A-5F show a progression of exploded views showing assembly of the example interior assembly shown in FIG. 4.
Figure 5B:
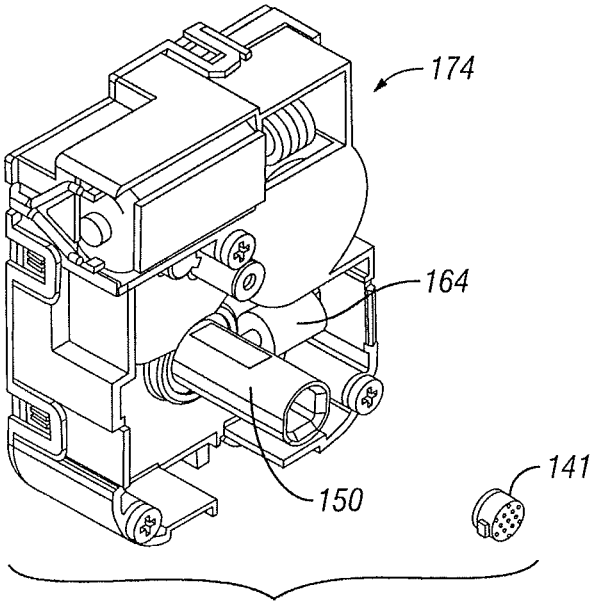
Figure 5C:
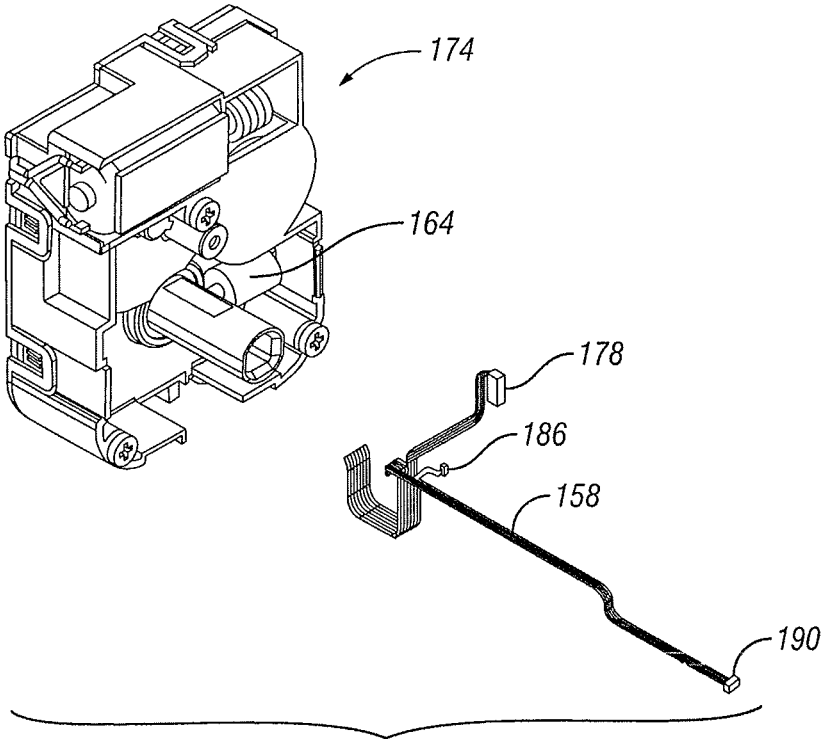
Figure 5D:
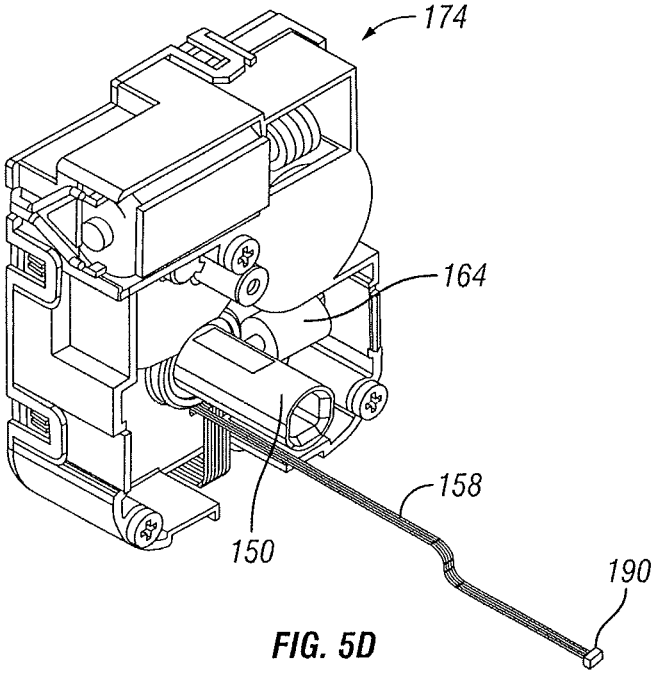
Figure 5E:
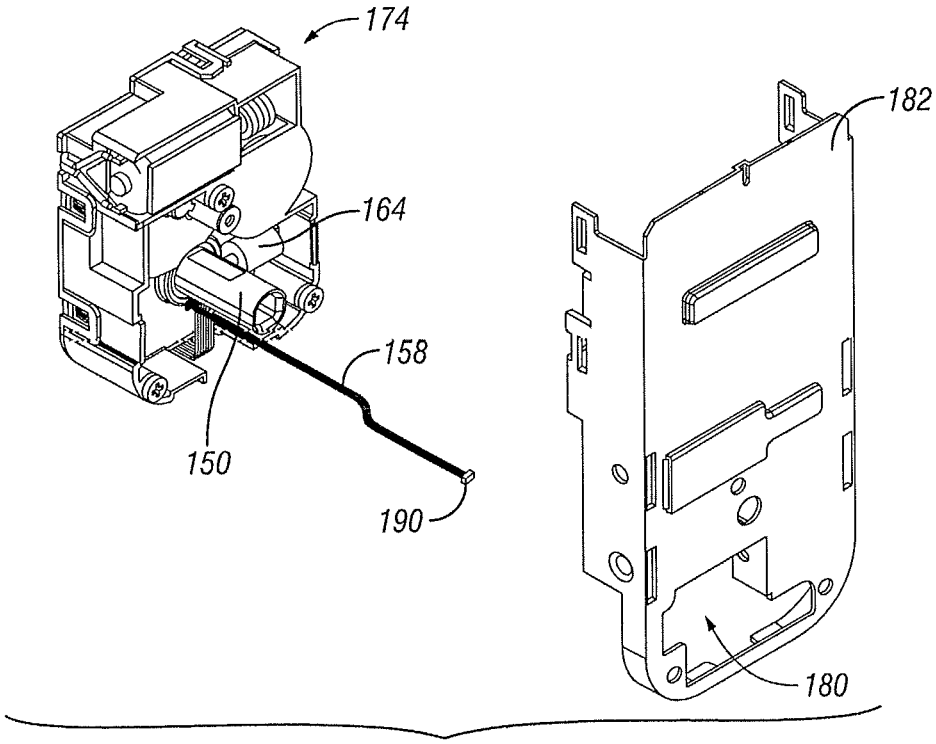
Figure 5F:
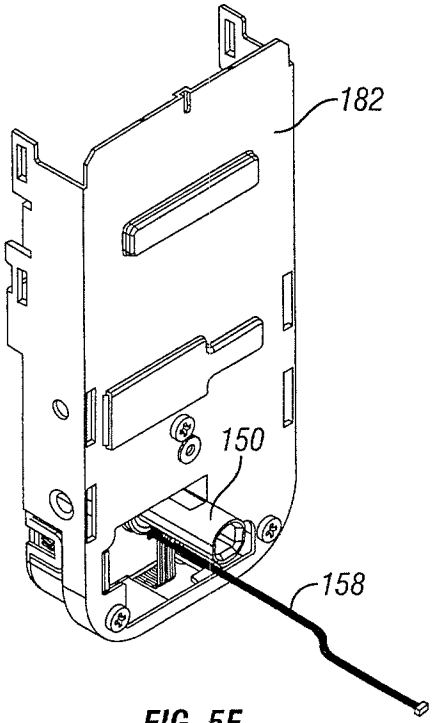

FIGS. 5A-5F show a progression of assembling a portion of the interior assembly 106 according to one embodiment. The transmission box 174 includes a void 188 dimensioned to receive the tamper lock 164 and speaker 141. FIGS. 5A and 5B show transmission box 174 prior to insertion of the tamper lock 164 and speaker 141 into the void 188, respectively. FIGS. 5C and 5D show the wiring harness 158 prior to and after connection with the tan per lock 164 and speaker 141, respectively. From these views, a third terminal 190 on the wiring harness 158 can be seen for connecting to the sensor assembly 138. FIGS. 5E and 5F show the back plate 182 prior to and after attachment of the transmission box 174. As seen in FIG. 5F, the interior driver 150 and wiring harness 158 extend through the opening 180 in the back plate 182.

Figure 6A:
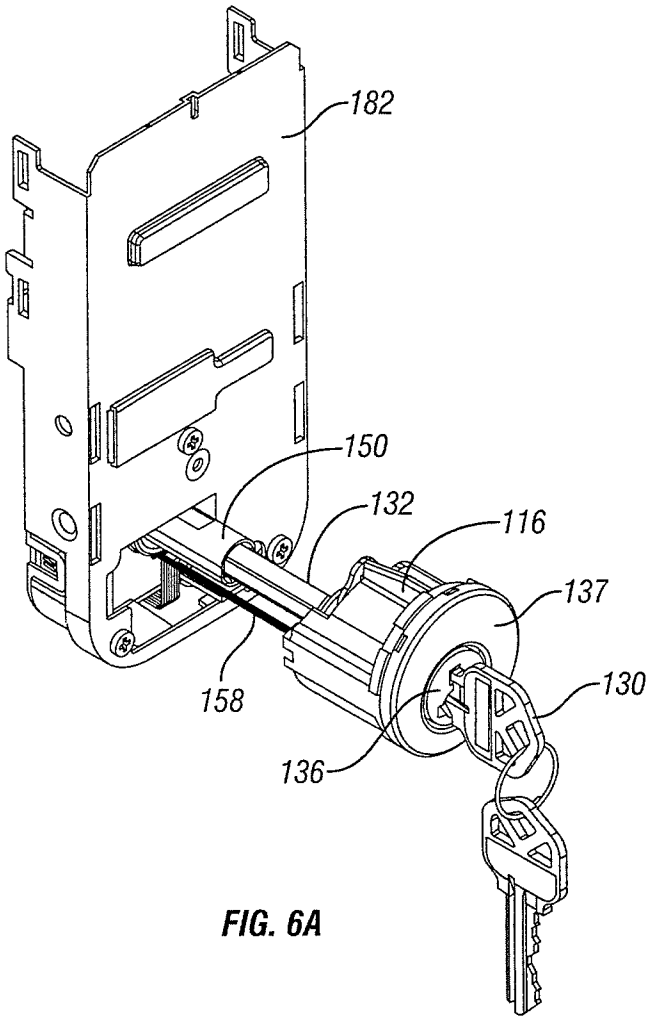
FIGS. 6A-6F show a progression of views removing components to show the electrical connection of the sensor assembly, tamper lock and speaker.
Figure 6B:
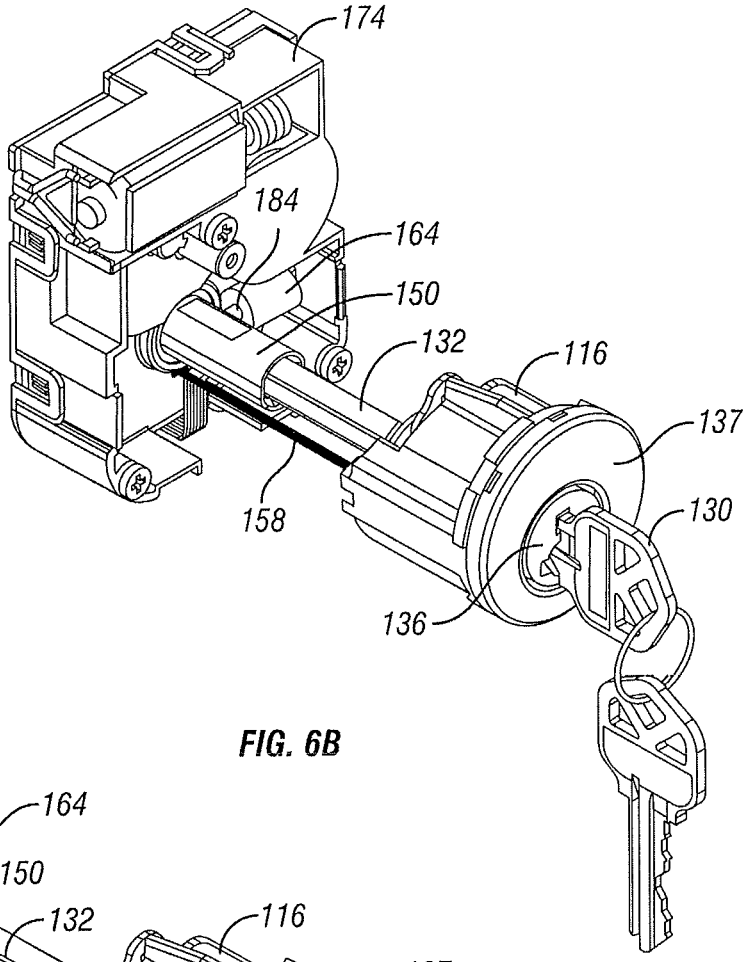
Figure 6C:
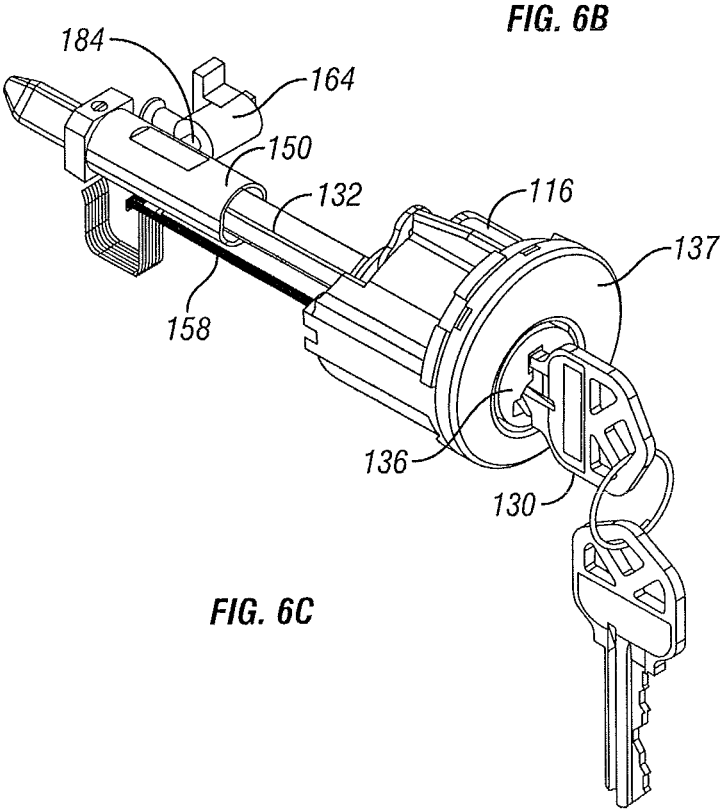
Figure 6D:
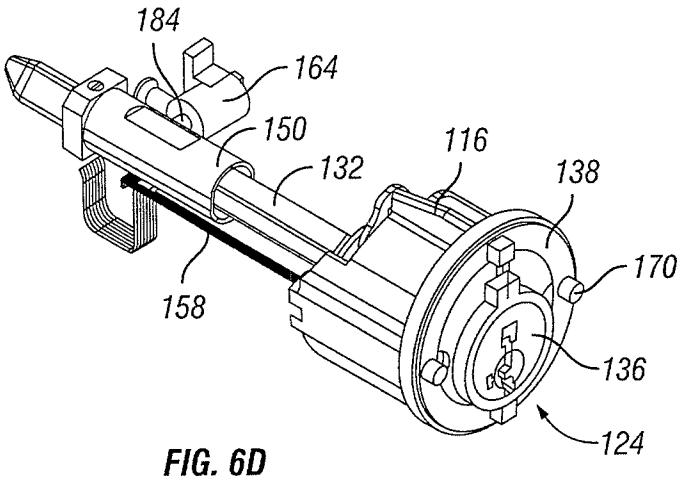
Figure 6F:
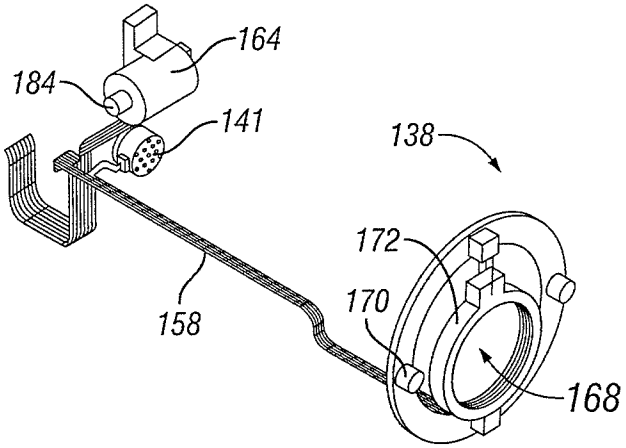
Figure 6E:
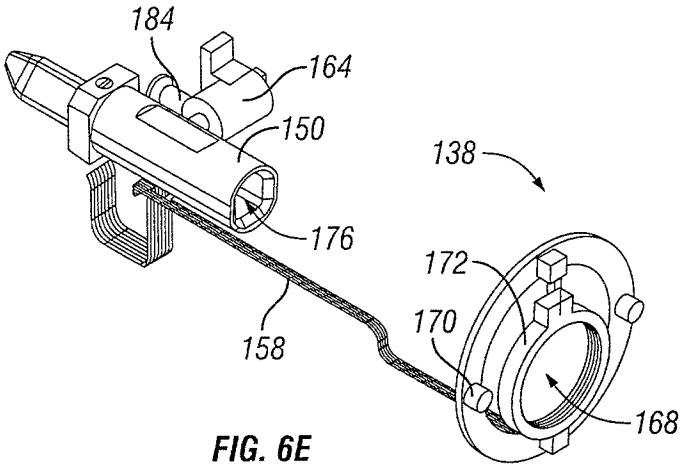

FIGS. 6A-6F show a progression of views in which components of the lock assembly 100 are removed to reveal other components. FIG. 6A shows the lock assembly 100 with the torque blade 132 connected directly to the interior driver 150 (the latch assembly 104 would typically be disposed between the exterior assembly 102 and the interior assembly 106). FIG. 6B removes the back plate 182 from the interior assembly 106 to reveal more of the transmission box 174. FIG. 6C removes the transmission box 174 to reveal more of the interior driver 150 and tamper lock 164. FIG. 6D removes the cover 137 from the exterior assembly 102. FIG. 6E removes the cylinder body 116, cylinder plug 120 and torque blade 132 to better reveal the wiring harness 158. FIG. 6F removes the interior driver 150 to reveal the speaker 141.

Figure 7:
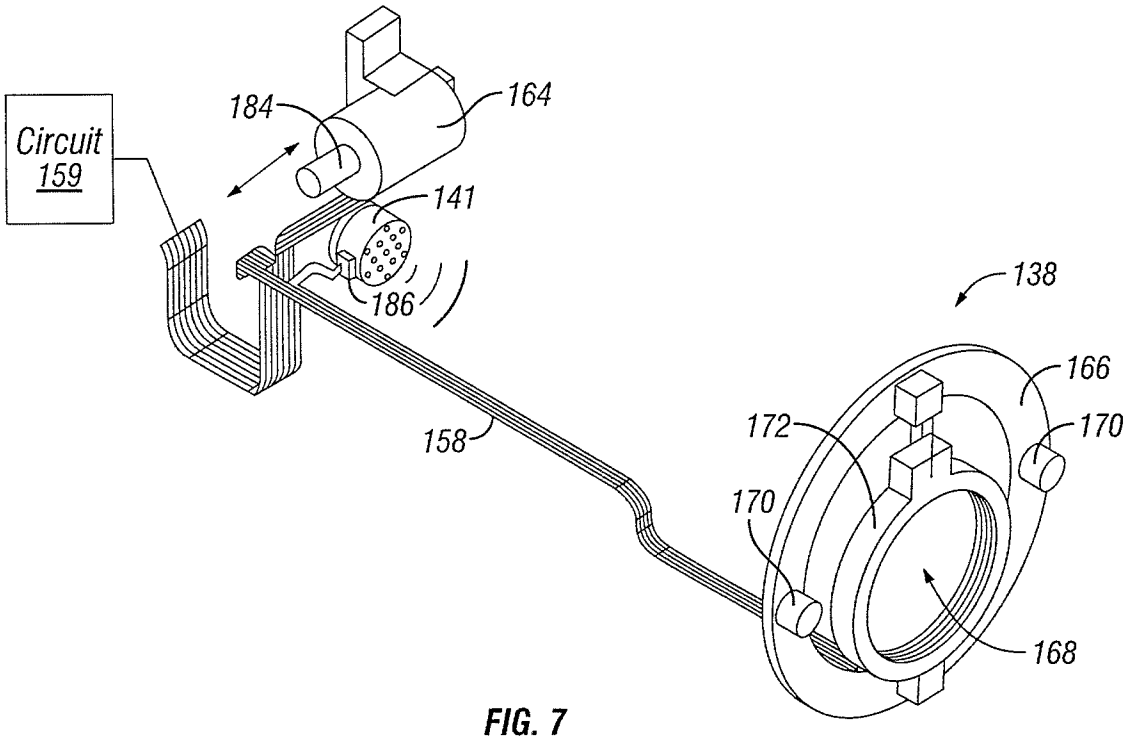
FIG. 7 is a diagrammatic view of electrical connections with the sensor assembly, tamper lock and speaker.

FIG. 7 shows the electrical connection between the sensor assembly 138, tamper lock 164, speaker 141 and circuit 159 (shown diagrammatically in FIG. 7) according to one embodiment. As discussed above, circuit 159 is configured to control actuation of an audible alarm with speaker 141 responsive to detection of tampering by sensor assembly 138. In some embodiments, the circuit 159 may also actuate the tamper lock 164 responsive detection of tampering by sensor assembly 138. In some cases, the circuit 159 may transmit a wireless communication identifying tampering of the lock assembly 100.

Figure 8A:
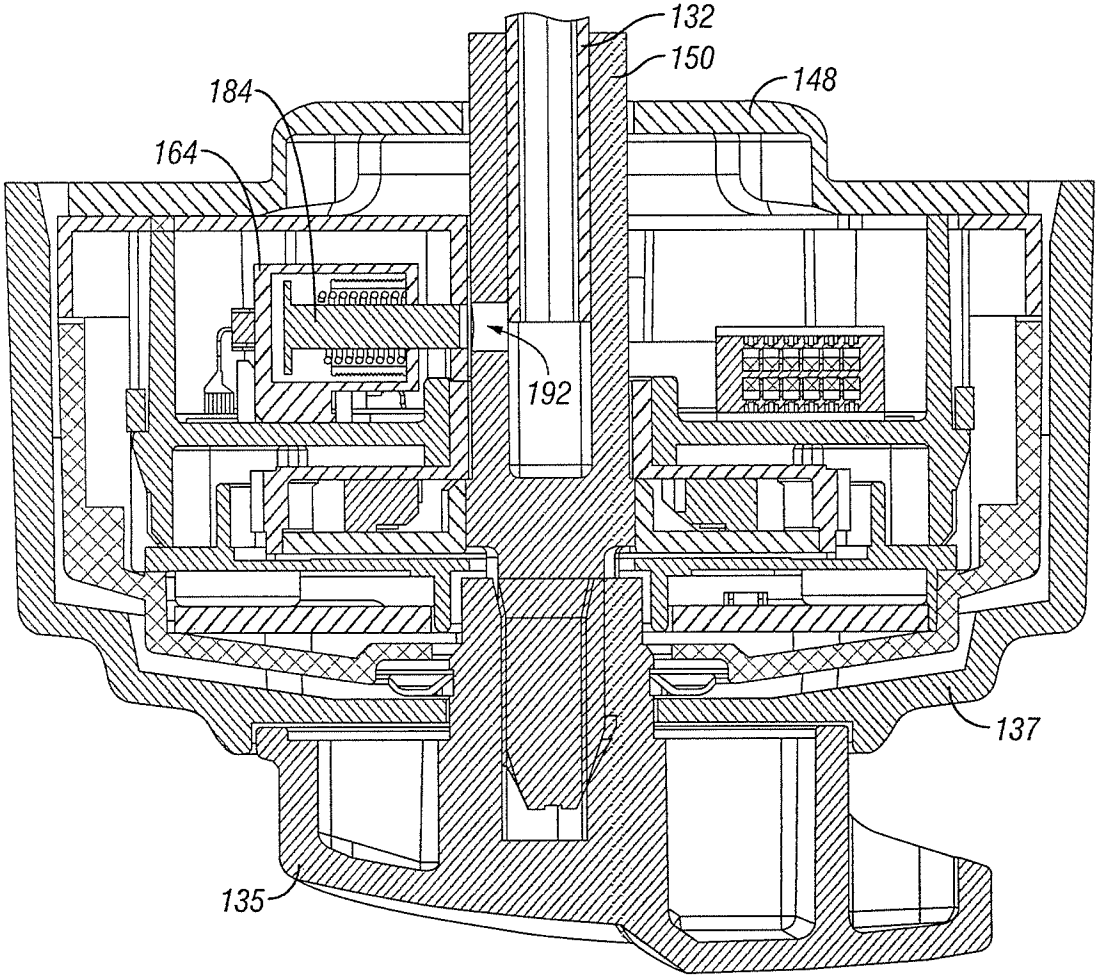
FIGS. 8A and 8B are top cross-sectional views of the example interior assembly shown in FIG. 4 with the tamper lock in an unlocked position and locked position, respectively.
Figure 8B:
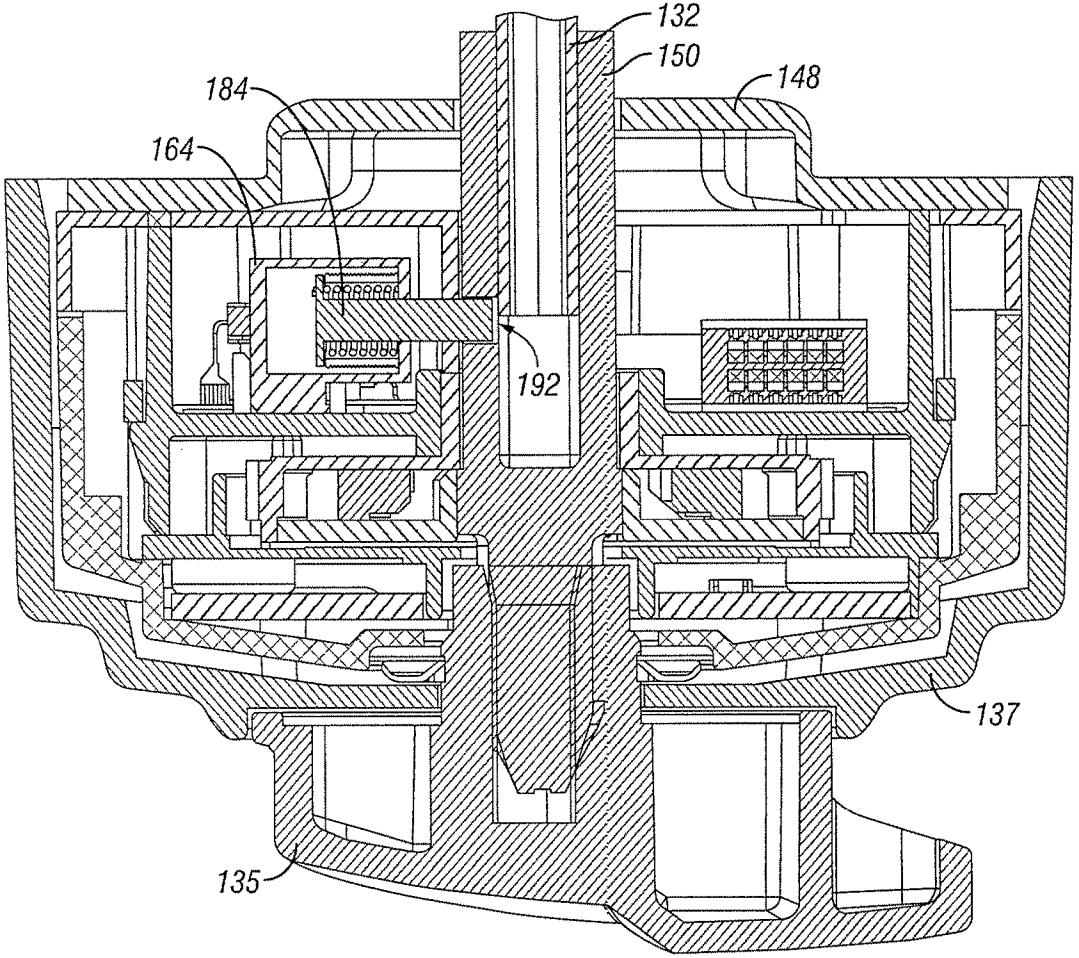
Figure 10:
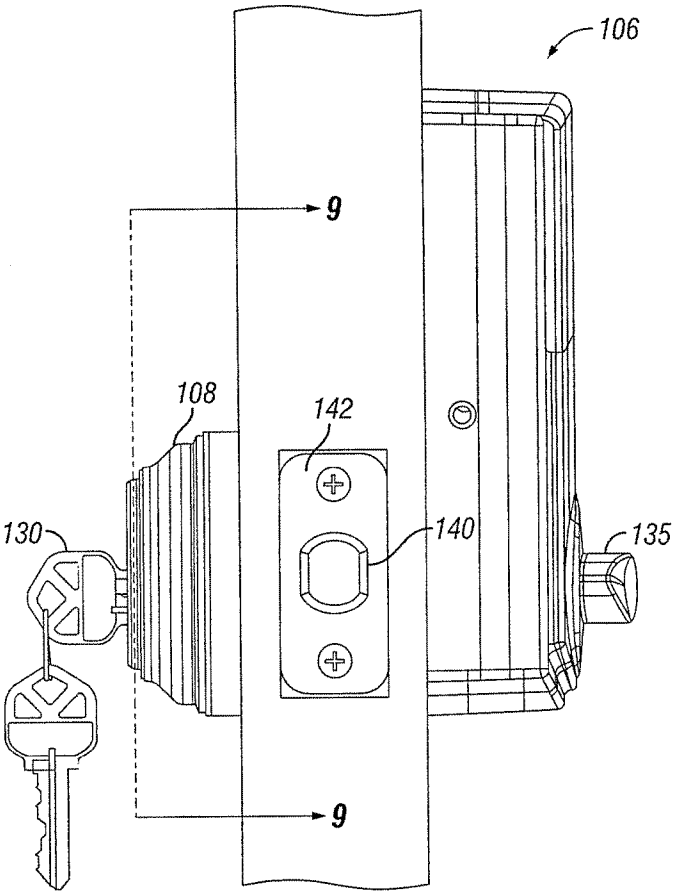
FIG. 10 is a side view of an example lock assembly installed on a door according to an embodiment of this disclosure.
Figure 9:
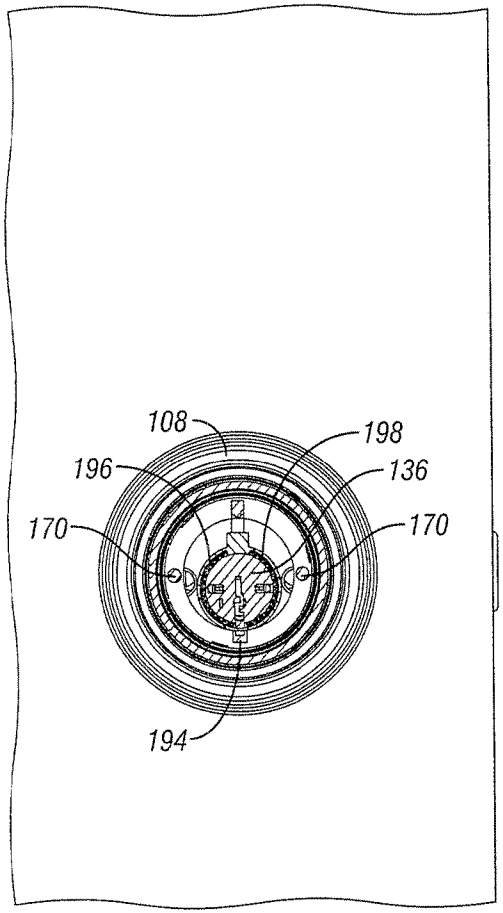
FIG. 9 is a front cross-sectional view of an example exterior assembly along line 9-9 in FIG. 10 showing an embodiment in which the sensor assembly detects tampering using a strain gauge.
Figure 12:
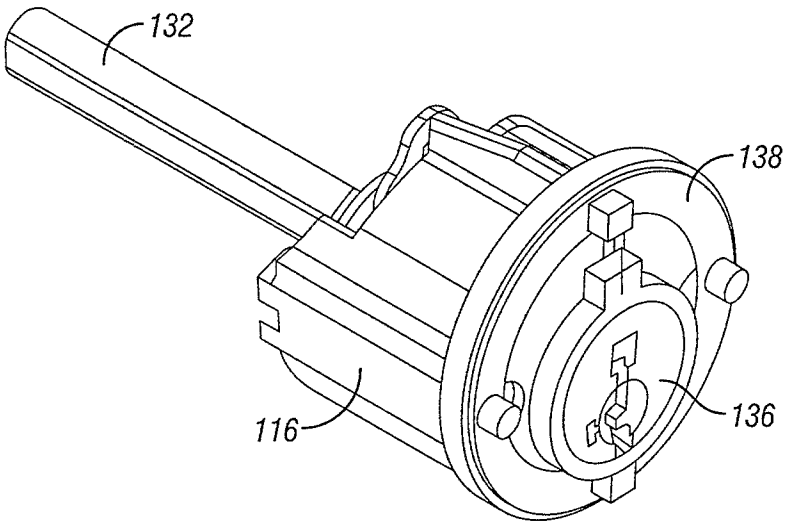
FIG. 12 is a perspective view of the example exterior assembly shown in FIG. 10 with the cover and cylinder guard removed to show other components.
Figure 11:
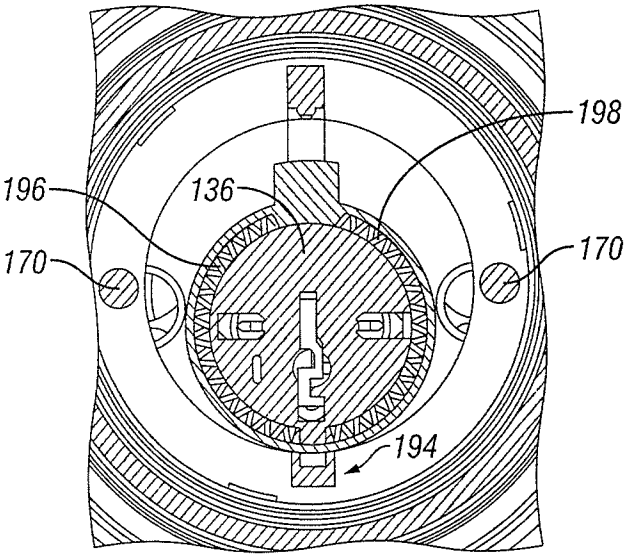
FIG. 11 is a detailed view of the exterior assembly shown in FIG. 9.
Figure 14:
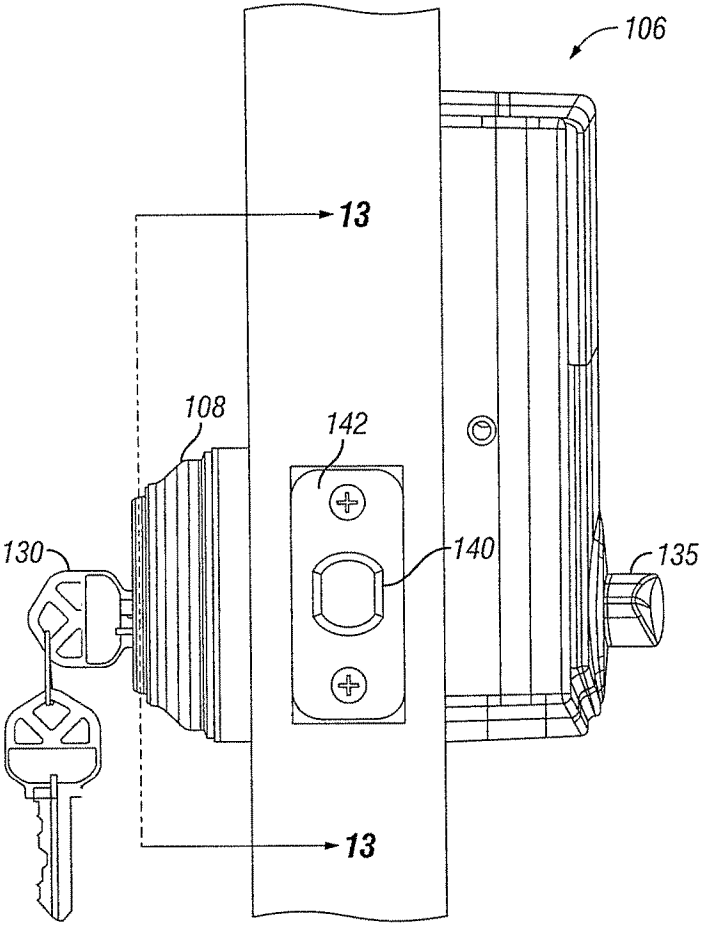
FIG. 14 is a side view of an example lock assembly installed on a door according to an embodiment of this disclosure.
Figure 13:
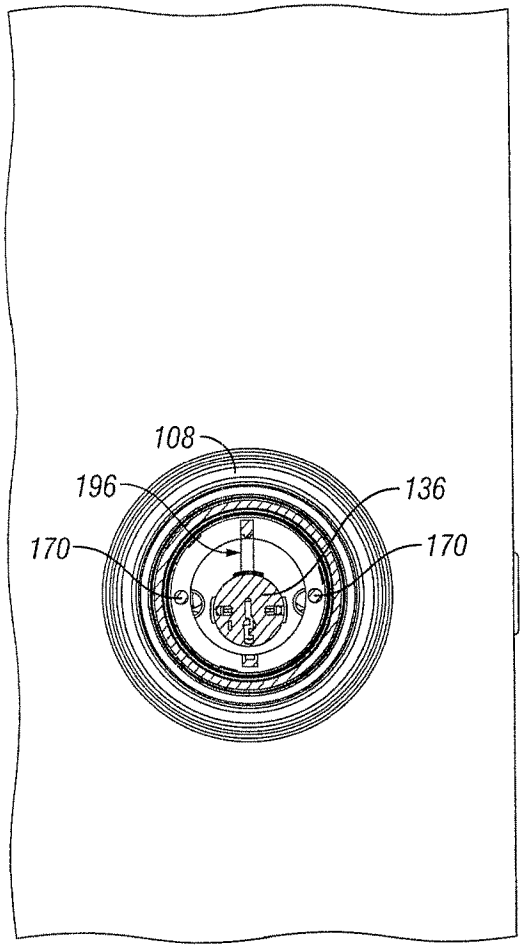
FIG. 13 is a front cross-sectional view of an example exterior assembly along line 13-13 in FIG. 14 showing an embodiment in which the sensor assembly detects tampering using a continuity sensor.
Figure 16:
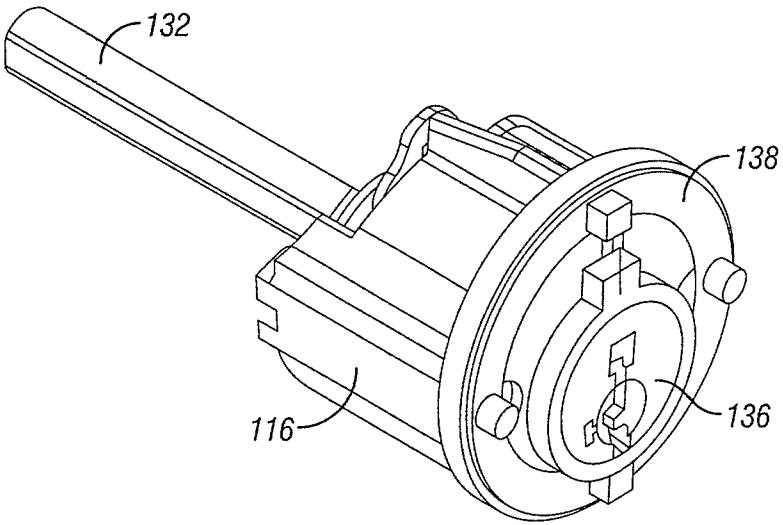
FIG. 16 is a perspective view of the example exterior assembly shown in FIG. 14 with the cover and cylinder guard removed to show other components.
Figure 15:
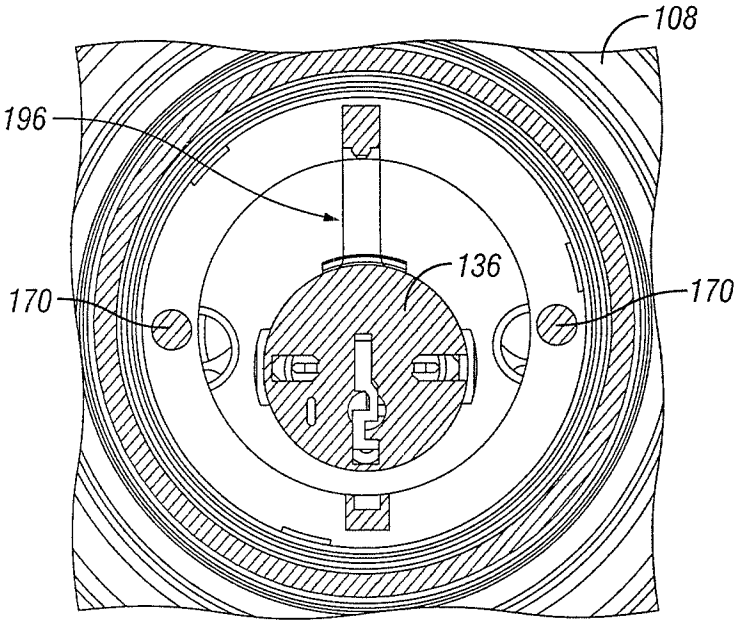
FIG. 15 is a detailed view of the exterior assembly shown in FIG. 13.
Figure 18:
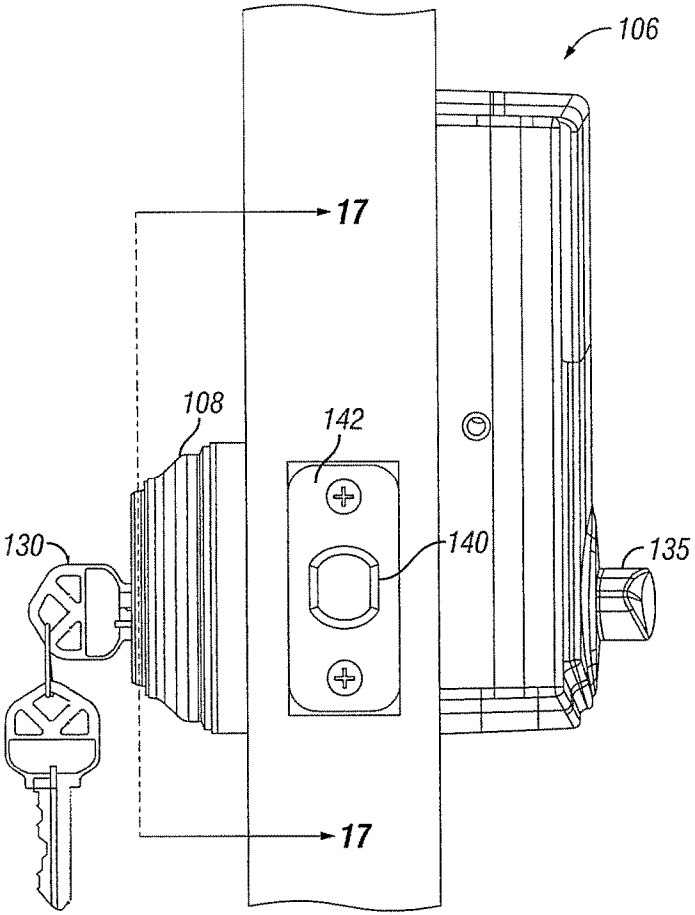
FIG. 18 is a side view of an example lock assembly installed on a door according to an embodiment of this disclosure.
Figure 17:
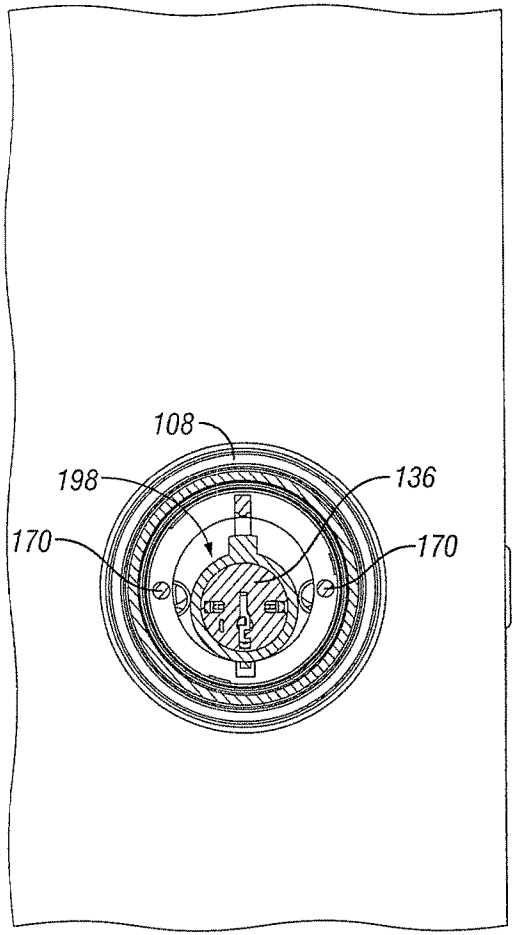
FIG. 17 is a front cross-sectional view of an example exterior assembly along line 17-17 in FIG. 18 showing an embodiment in which the sensor assembly detects tampering using a contact microphone.
Figure 20:
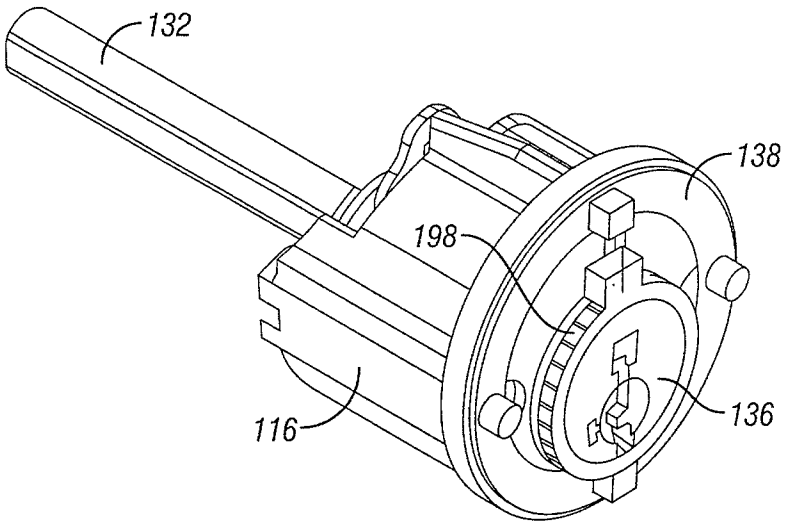
FIG. 20 is a perspective view of the example exterior assembly shown in FIG. 18 with the cover and cylinder guard removed to show other components.
Figure 19:
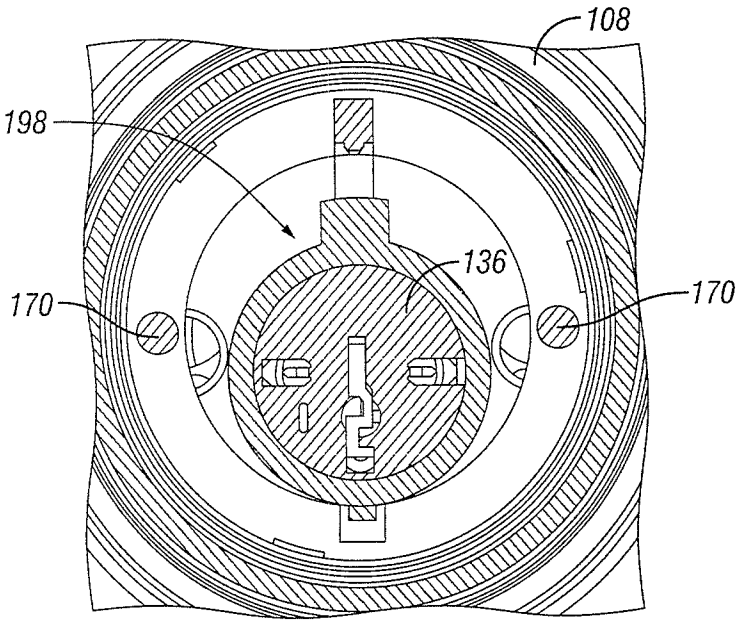
FIG. 19 is a detailed view of the exterior assembly shown in FIG. 17.
Figure 22:
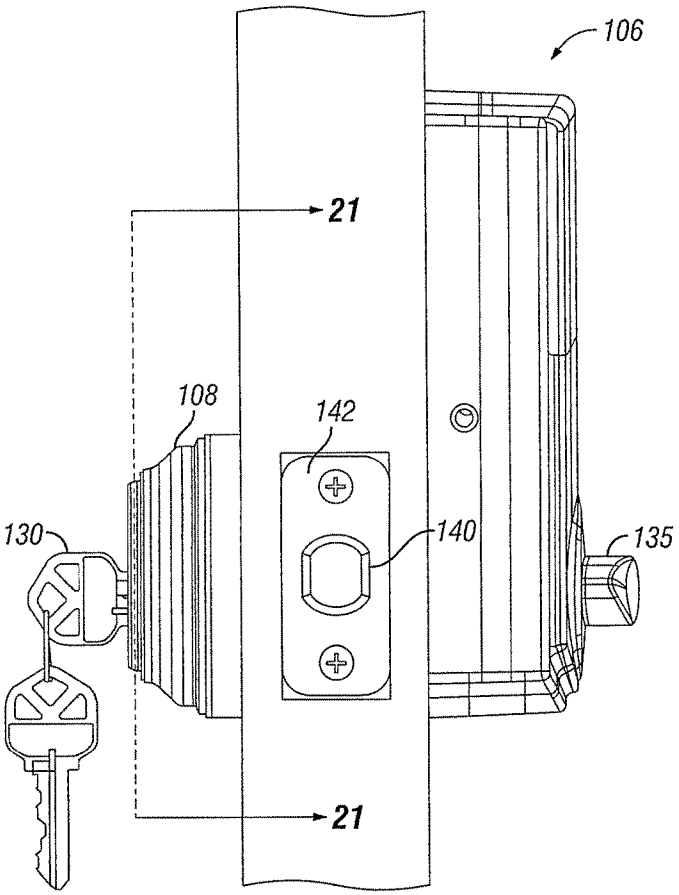
FIG. 22 is a side view of an example lock assembly installed on a door according to an embodiment of this disclosure.
Figure 21:
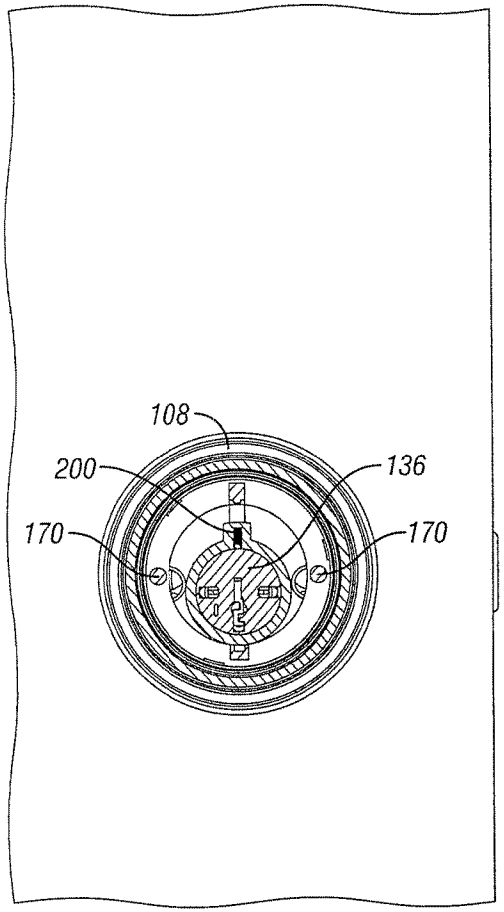
FIG. 21 is a front cross-sectional view of an example exterior assembly along line 21-21 in FIG. 22 showing an embodiment in which the sensor assembly detects tampering using a micro-switch.
Figure 24:
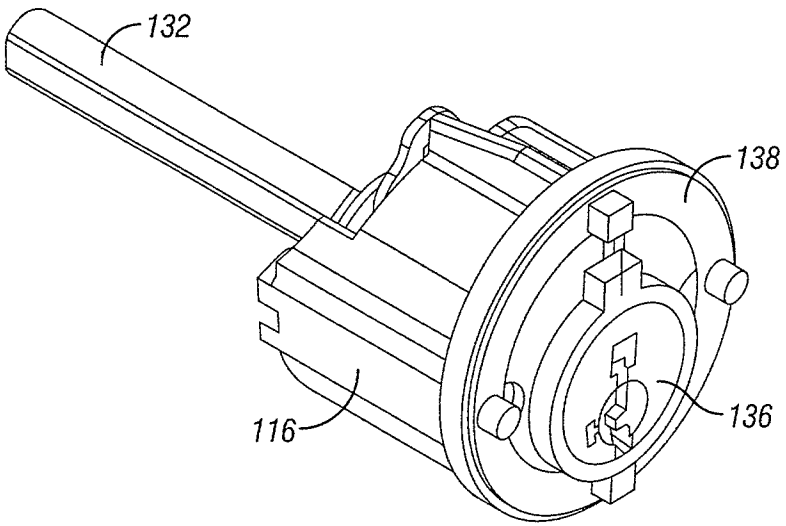
FIG. 24 is a perspective view of the example exterior assembly shown in FIG. 22 with the cover and cylinder guard removed to show other components.
Figure 23:
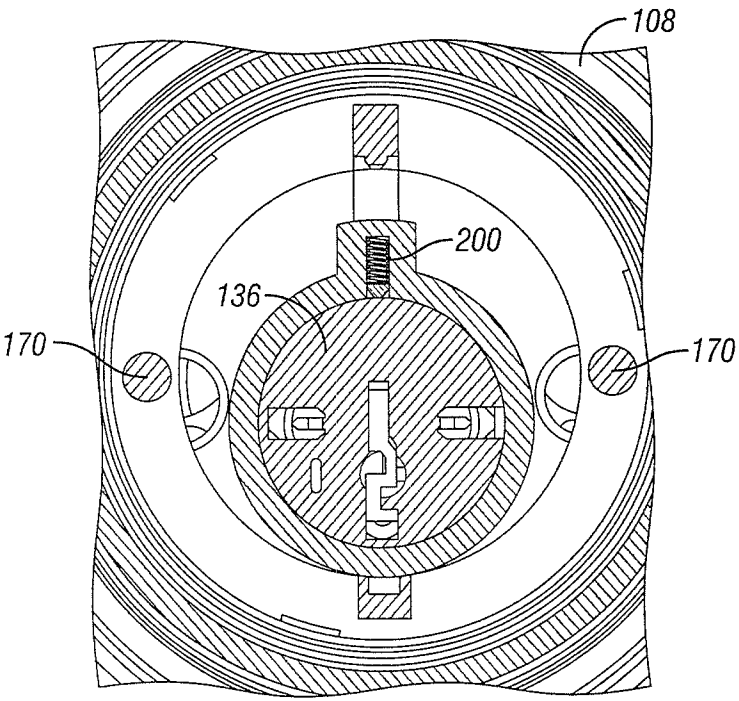
FIG. 23 is a detailed view of the exterior assembly shown in FIG. 21.
Figure 26:
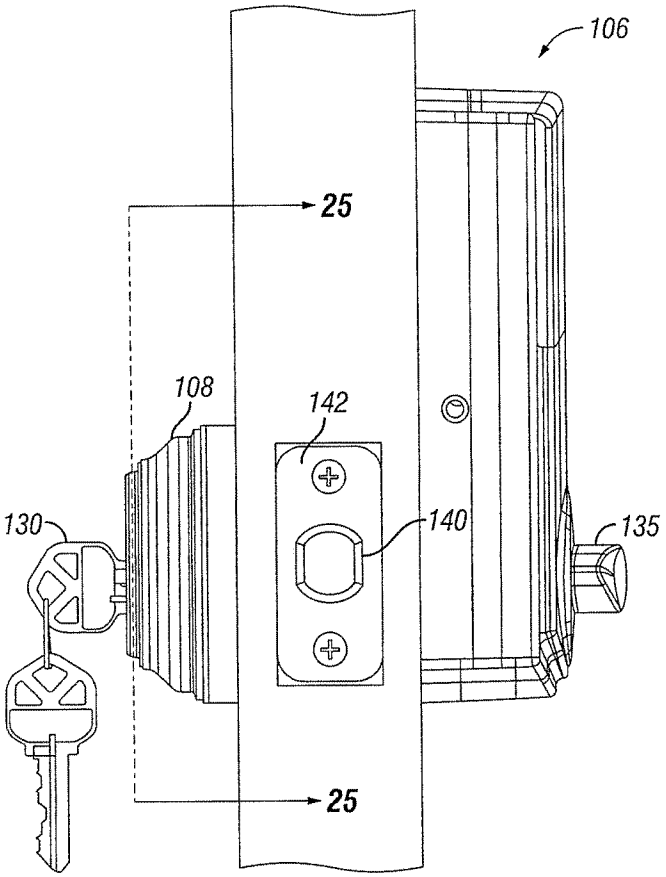
FIG. 26 is a side view of an example lock assembly installed on a door according to an embodiment of this disclosure.
Figure 25:
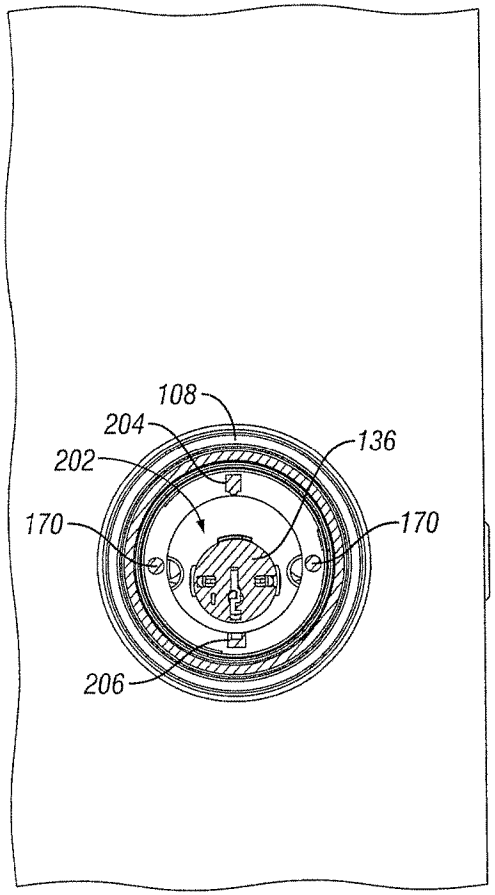
FIG. 25 is a front cross-sectional view of an example exterior assembly along line 25-25 in FIG. 26 showing an embodiment in which the sensor assembly detects tampering using an optical sensor.
Figure 28:
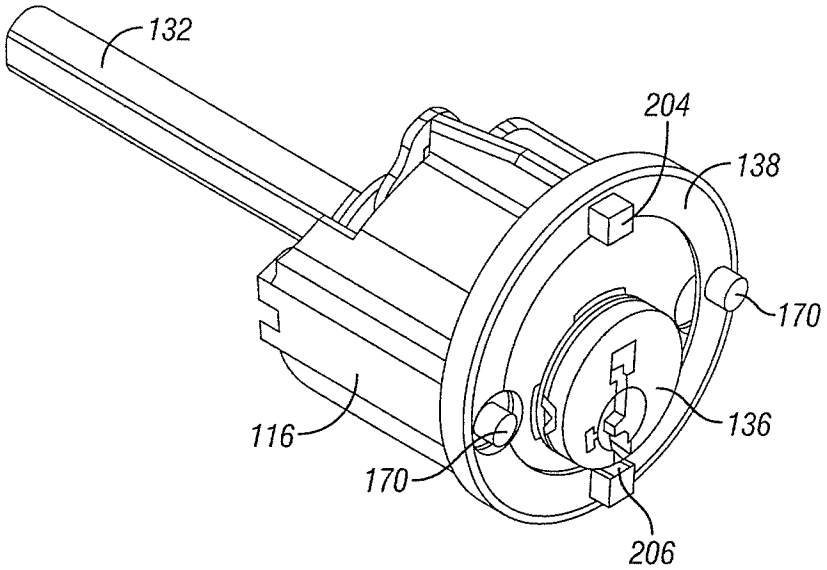
FIG. 28 is a perspective view of the example exterior assembly shown in FIG. 26 with the cover and cylinder guard removed to show other components.
Figure 27:
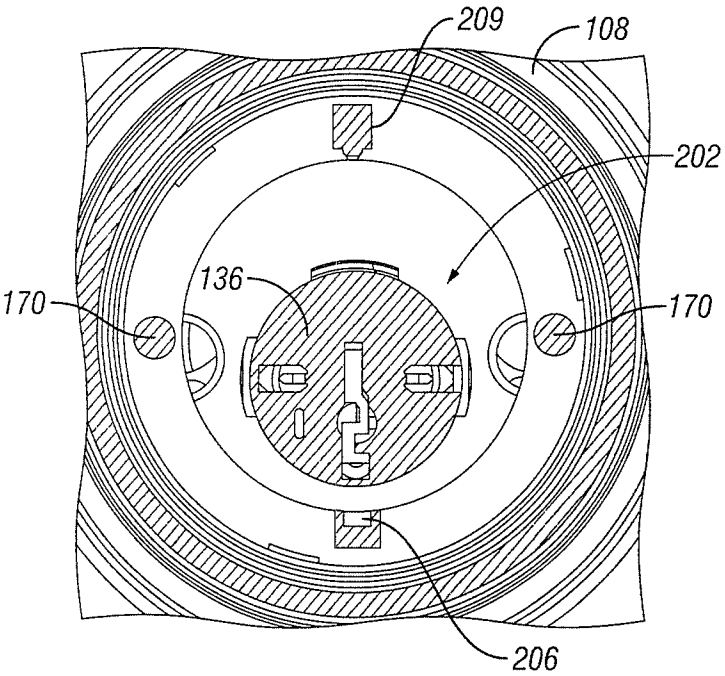
FIG. 27 is a detailed view of the exterior assembly shown in FIG. 25.

FIGS. 8A and 8B show a top cross-sectional view of the interior assembly 106. From this view, the interaction between the tamper lock 164 and the interior driver 150 can be seen. In FIG. 8A, the bolt 184 of the tamper lock 164 is in the retracted position out of the opening 192 in the interior driver 150. In this retracted position, the bolt 184 of the tamper lock 164 does not restrict rotation of the interior driver 150. Accordingly, movement of the interior driver 150 is unimpeded with the bolt 184 in the retracted position. FIG. 8B shows the bolt 184 in the extended position in which the bolt 184 is received from the opening 192 of the interior driver 150. For example, circuit 159 could have actuated the tamper lock in response to the sensor assembly 138 detecting tampering, which moves the bolt 184 to the extended position. With the bolt 184 in the extended position in the interior driver 150, this blocks rotation of the interior driver 150. As a result of the interior driver 150 being blocked from rotating, this also prevents rotation of the torque blade 132. For example, the torque blade 132 and opening 176 in the interior driver 150 could be non-circular shapes to prevent rotation of the torque blade 132 with respect to the interior driver 150. As a result of the tamper lock 164, the lock assembly 100 can be rendered inoperative responsive to detection by the sensor assembly 138 of tampering.

FIGS. 9-24 show certain embodiments of the sensor assembly 138 for detecting tampering (or other manipulation) of the cylinder plug 120 based on the cover 136. One skilled in the art should appreciate that these embodiments are merely examples of sensor types for detecting manipulation of the cover 136 and this disclosure is not intended to be restricted to only these specific embodiments.

FIGS. 9-12 show example embodiment in which the sensor assembly 138 detects tampering with the cylinder plug 120 based on whether excess torque is applied to the cover 136 using a strain gauge sensor 194. In the example shown, the strain gauge sensor 194 detects torque applied to a left spring 196 and a right spring 198 (best seen in FIG. 11). If the strain gauge sensor 194 detects a torque load exceeding a preset torque limit, a signal will be sent to the circuit 159, which would sound an alarm with the speaker 141 and/or actuate the tamper lock 164 to prevent unlocking of the lock assembly 100.

FIGS. 13-16 show an example embodiment in which the sensor assembly 138 detects tampering with the cylinder plug 120 based on whether excess torque is applied to the cover 136 using a continuity sensor 196. The continuity sensor 196 would complete a circuit and would be configured to open the circuit if the cover 136 deforms and/or separates from the cylinder plug 120. If the continuity sensor 196 detects manipulation of cover 136 (i.e., separation of the cover 136 from the cylinder plug 120 opens the circuit), this open will be an input to the circuit 159 indicating tampering of the lock assembly 100, which will sound a alarm with the speaker 141 and/or actuate the tamper lock 164 to prevent unlocking of the lock assembly 100.

FIGS. 17-20 show an example embodiment in which the sensor assembly 138 detects tampering with the cylinder plug 120 based on whether excess torque is applied to the cover 136 using a contact microphone 198. The contact microphone would detect if the cover 136 deforms and/or separates from the cylinder plug 120. If the contact microphone 198 detects manipulation of cover 136 (i.e., separation and/or deformation of the cover 136 from the cylinder plug 120), this will be an input to the circuit 159 indicating tampering of the lock assembly 100, which will sound an alarm with the speaker 141 and/or actuate the tamper lock 164 to prevent unlocking of the lock assembly 100.

FIGS. 21-24 show an example embodiment in which the sensor assembly 138 detects tampering with the cylinder plug 120 based on whether excess torque is applied to the cover 136 using a micro-switch 200. Due to the position of the micro-switch 200 against the surface of the cover 136, the micro-switch 200 would detect if the cover 136 deforms and/or separates from the cylinder plug 120. If the micro-switch 200 detects manipulation of cover 136 (i.e., separation and/or deformation of the cover 136 from the cylinder plug 120), this will be an input to the circuit 159 indicating tampering of the lock assembly 100, which will sound an alarm with the speaker 141 and/or actuate the tamper lock 164 to prevent unlocking of the lock assembly 100.

FIGS. 25-28 show an example embodiment in which the sensor assembly 138 detects tampering with the cylinder plug 120 based on whether excess torque is applied to the cover 136 using an optical sensor 202. In this example, the optical sensor 202 includes a light source 204 and light sensor 206 on opposing ends of the cover 136. During normal use, the cover 136 blocks the light source 204 from the light sensor 206. If the cover 36 deforms and/or separates from the cylinder plug 120, however, the light source 204 will be detected by the light sensor 206. In the example shown, the light source 204, light sensor 206 and cover 136 are coaxial along an axis generally transverse to the keyway axis. If the optical sensor 202 detects manipulation of cover 136 (i.e., separation of the cover 136 from the cylinder plug 120), this will be an input to the circuit 159 indicating tampering of the lock assembly 100, which will sound an alarm with the speaker 141 and/or actuate the tamper lock 164 to prevent unlocking of the lock assembly 100. Although the light source 204 is on top of cover 136 and light sensor 206 is on the bottom of the cover 136 in the example shown, the light source 204 and light sensor 206 could be positioned elsewhere along the cover 136 as long as light source 204 is not detected by light sensor 206 when cover 136 is operating normally, but light source 204 is detected by light sensor 206 when cover 136 deforms and/or separates from the cylinder plug 120.

In operation, the lock assembly 100 is configured to detect tampering with the cylinder plug based on the cover 136. For example, the lock assembly 100 detects when a screwdriver (or other manipulation tool) is used to apply excess torque on the cover 136. This excess torque will cause the cover 136 to deform and/or separate from the cylinder plug 120. The sensor assembly 138 will detect when this happens—whether using a strain gauge, continuity circuit, optical sensor, accelerometer, micro-switch, contact microphone and/or other sensor. In response to the sensor assembly 138 detecting tampering with the cylinder plug 120, the circuit 159 could sound an alarm via speaker 141 and/or actuate the tamper lock 164.

EXAMPLES

Illustrative examples of the technologies disclosed herein are provided below. An embodiment of the technologies may include any one or more, and any combination of, the examples described below.

Example 1 is a lock cylinder with a cylinder body, a cylinder plug and a sensor assembly. The cylinder plug is disposed in the cylinder body and includes at least a portion configured to deform and/or separate from the cylinder body when a sufficient force is applied. The sensor assembly is configured to detect when the cylinder plug deforms and/or separates from the cylinder body.

In Example 2, the subject matter of Example 1 is further configured such that the sensor assembly detects when the cylinder plug deforms and/or separates from the cylinder body with a strain gauge.

In Example 3, the subject matter of Example 2 is further configured such that the strain gauge includes at least one spring surrounding at least a portion of the cylinder plug.

In Example 4, the subject matter of Example 1 is further configured such that the sensor assembly detects when the cylinder plug deforms and/or separates from the cylinder body with a continuity circuit.

In Example 5, the subject matter of Example 4 is further configured such that the continuity circuit is configured to become an open circuit when the cylinder plug deforms and/or separates from the cylinder body.

In Example 6, the subject matter of Example 1 is further configured such that the sensor assembly detects when the cylinder plug deforms and/or separates from the cylinder body with a micro-switch.

In Example 7, the subject matter of Example 6 is further configured such that the micro-switch contacts a portion of the cylinder plug.

In Example 8, the subject matter of Example 1 is further configured such that the sensor assembly detects when the cylinder plug deforms and/or separates from the cylinder body with an optical sensor.

In Example 9, the subject matter of Example 8 is further configured such that the optical sensor includes a light source and a light sensor.

In Example 10, the subject matter of Example 9 is further configured such that a portion of the cylinder plug blocks the light source from the light sensor prior to separation of the cylinder plug from the cylinder body.

In Example 11, the subject matter of Example 10 is further configured such that the light sensor detects the light source upon the deformation and/or separation of the cylinder plug from the cylinder body.

In Example 12, the subject matter of Example 1 is further configured such that the sensor assembly detects when the cylinder plug deforms and/or separates from the cylinder body with a contact microphone.

In Example 13, the subject matter of Example 1 is further configured such that the sensor assembly includes an opening dimensioned to receive the cylinder plug.

In Example 14, the subject matter of Example 13 is further configured such that sensor assembly includes a raised edge surrounding the opening.

In Example 15, the subject matter of Example 14 is further configured such that the sensor assembly includes one or more sensors in the raised edge.

In Example 16, the subject matter of Example 13 is further configured such that the opening in the sensor assembly is coaxial with an opening in the cylinder body that receives the cylinder plug.

In Example 17, the subject matter of Example 16 is further configured such that at least a portion of the sensor assembly contacts the cylinder body.

Example 18 is a lock cylinder with a cylinder body and a cylinder plug. The cylinder plug disposed in the cylinder body and includes a portion configured to deform and/or separate from the cylinder body when a sufficient force is applied to the cylinder plug. The lock cylinder also includes means for detecting when at least a portion of the cylinder plug deforms and/or separates from the cylinder body.

In Example 19, the subject matter of Example 18 is further configured such that the means for detecting when at least a portion of the cylinder plug deforms and/or separates from the cylinder body includes a strain gauge.

In Example 20, the subject matter of Example 19 is further configured such that the strain gauge includes at least one spring surrounding at least a portion of the cylinder plug.

In Example 21, the subject matter of Example 18 is further configured such that the means for detecting when at least a portion of the cylinder plug deforms and/or separates from the cylinder body includes a continuity circuit.

In Example 22, the subject matter of Example 21 is further configured such that the continuity circuit is configured to become an open circuit when the cylinder plug deforms and/or separates from the cylinder body.

In Example 23, the subject matter of Example 18 is further configured such that the means for detecting when at least a portion of the cylinder plug deforms and/or separates from the cylinder body includes a micro-switch.

In Example 24, the subject matter of Example 23 is further configured such that the micro-switch contacts a portion of the cylinder plug.

In Example 25, the subject matter of Example 18 is further configured such that the means for detecting when at least a portion of the cylinder plug deforms and/or separates from the cylinder body includes an optical sensor.

In Example 26, the subject matter of Example 25 is further configured such that the optical sensor includes a light source and a light sensor.

In Example 27, the subject matter of Example 26 is further configured such that at least a portion of the cylinder plug blocks the light source from the light sensor prior to deformation and/or separation of the cylinder plug from the cylinder body.

In Example 28, the subject matter of Example 27 is further configured such that the light sensor detects the light source upon the cylinder plug deforming and/or separating from the cylinder body.

In Example 29, the subject matter of Example 18 is further configured such that the means for detecting when at least a portion of the cylinder plug deforms and/or separates from the cylinder body includes a contact microphone.

In Example 30, the subject matter of Example 18 is further configured such that the sensor assembly includes an opening dimensioned to receive the cylinder plug.

In Example 31, the subject matter of Example 30 is further configured such that the sensor assembly includes a raised edge surrounding the opening.

In Example 32, the subject matter of Example 31 is further configured such that the sensor assembly includes one or more sensors in the raised edge.

In Example 33, the subject matter of Example 31 is further configured such that the opening in the sensor assembly is coaxial with an opening in the cylinder body that receives the cylinder plug.

In Example 34, the subject matter of Example 33 is further configured such that at least a portion of the sensor assembly contacts the cylinder body.

Example 35 is a lockset with an exterior assembly and an interior assembly. The exterior assembly comprises a cylinder body and a cylinder plug disposed in the cylinder body. The cylinder plug includes a portion configured to deform and/or separate from the cylinder body when a sufficient force is applied. The exterior assembly includes a sensor assembly configured to detect when at least a portion of the cylinder plug deforms and/or separates from the cylinder body. The interior assembly comprises an interior driver operatively coupled to the cylinder plug with a torque blade extending therebetween. A circuit is provided in the interior assembly that is electrically connected to the sensor assembly. The interior driver is configured to control movement of the interior driver. The interior assembly includes a tamper lock operative to restrict movement of the interior driver. The circuit is configured to actuate the tamper lock responsive to detection by the sensor assembly that at least a portion of the cylinder plug has deformed and/or separated from the cylinder body.

In Example 36, the subject matter of Example 35 is further configured such that the circuit is configured to signal an alarm responsive to detection by the sensor assembly that at least a portion of the cylinder plug has deformed and/or separated from the cylinder body.

In Example 37, the subject matter of Example 35 is further configured such that the lockset further comprising a speaker in electrical communication with the circuit. The circuit is configured to actuate an audible alarm with the speaker responsive to detection by the sensor assembly that at least a portion of the cylinder plug has deformed and/or separated from the cylinder body.

In Example 38, the subject matter of Example 35 is further configured such that the lockset further comprises a wireless communication device in electrical communication with the circuit. The circuit is configured to transmit a wireless message with the wireless communication device indicating that the sensor assembly has detected deformation and/or separation of the cylinder plug from the cylinder body.

In Example 39, the subject matter of Example 35 is further configured such that the tamper lock includes a solenoid with a bolt movable between an extended and retracted position. The circuit controls movement of the bolt between the extended and retracted positions.

In Example 40, the subject matter of Example 39 is further configured such that the interior driver includes an opening into which the bolt of the solenoid is received when in the extended position.

Example 41 is a method of detecting tampering with a lock cylinder. The method includes the step of providing a cylinder body. A cylinder plug is provided that is disposed in the cylinder body. The cylinder plug includes a portion configured to deform and/or separate from the cylinder body when a sufficient force is applied. The method includes the step of monitoring the cylinder plug to detect when at least a portion of the cylinder plug deforms and/or separates from the cylinder body. In response to detection that at least a portion of the cylinder plug has deformed and/or separated from the cylinder body, an electrical signal is generated that indicates tampering of the cylinder plug.

In Example 42, the subject matter of Example 41 is further configured such that the method further includes the step of generating an audible alarm responsive to detection that at least a portion of the cylinder plug has deformed and/or separated from the cylinder body.

In Example 43, the subject matter of Example 41 is further configured such that the method further includes the step of actuating a tamper lock that locks the cylinder plug responsive to detection that at least a portion of the cylinder plug has deformed and/or separated from the cylinder body.

Although the present disclosure has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

The invention claimed is:

1. A lock cylinder comprising:

a cylinder body;

a cylinder plug disposed in the cylinder body, the cylinder plug including a cover attached to a face of the cylinder plug, the cover including a keyway, wherein the cover is configured to deform and/or separate from the cylinder body when a sufficient force is applied;

a sensor assembly configured to detect deformation and/or separation between the cover and the cylinder body, the sensor assembly including a base that defines an opening, the opening at least partially surrounding the cylinder plug; and an exterior cover fitted to the cylinder body, the sensor assembly being disposed between the cylinder body and the exterior cover.

2. The lock cylinder of claim 1, wherein the sensor assembly detects deformation and/or separation of the cover from the cylinder body with a strain gauge.

3. The lock cylinder of claim 2, wherein the strain gauge includes at least one spring surrounding at least a portion of the cylinder plug.

4. The lock cylinder of claim 1, wherein the sensor assembly detects deformation and/or separation of the cover from the cylinder body with a continuity circuit.

5. The lock cylinder of claim 4, wherein the continuity circuit is configured to become an open circuit when the cover deforms and/or separates from the cylinder body.

6. The lock cylinder of claim 1, wherein the sensor assembly detects deformation and/or separation of the cover from the cylinder body with a micro-switch.

7. The lock cylinder of claim 6, wherein the micro-switch contacts the cylinder plug.

8. The lock cylinder of claim 1, wherein the sensor assembly detects deformation and/or separation of the cover from the cylinder body with an optical sensor.

9. The lock cylinder of claim 8, wherein the optical sensor includes a light source and a light sensor.

10. The lock cylinder of claim 9, wherein a portion of the cylinder plug blocks the light source from the light sensor prior to deformation and/or separation of the cover.

11. The lock cylinder of claim 10, wherein the light sensor detects the light source upon the deformation and/or separation of the cover from the cylinder body.

12. The lock cylinder of claim 1, wherein the sensor assembly detects deformation and/or separation of the cover from the cylinder body with a contact microphone.

13. The lock cylinder of claim 1, wherein the sensor assembly includes an opening dimensioned to receive the cylinder plug.

14. The lock cylinder of claim 13, wherein the sensor assembly includes a raised edge surrounding the opening.

15. The lock cylinder of claim 14, wherein the sensor assembly includes one or more sensors in the raised edge.

16. The lock cylinder of claim 13, wherein the opening in the sensor assembly is coaxial with an opening in the cylinder body that receives the cylinder plug.

17. The lock cylinder of claim 16, wherein at least a portion of the sensor assembly contacts the cylinder body.

18. A lock cylinder comprising:

a cylinder body;

a cylinder plug disposed in the cylinder body, the cylinder plug including a cover attached to a face of the cylinder plug, the cover including a keyway, wherein the cover is configured to deform and/or separate from the cylinder body when a sufficient force is applied; and means for detecting deformation and/or separation between the cover of the cylinder plug and the cylinder body, wherein the means for detecting deformation and/or separation includes a sensor assembly positioned between the cover and the cylinder body and including a base that defines an opening, the opening at least partially surrounding the cylinder plug.

19. The lock cylinder of claim 18, wherein the means for detecting when at least a portion of the cover deforms and/or separates from the cylinder body includes a strain gauge.

20. The lock cylinder of claim 19, wherein the strain gauge includes at least one spring surrounding at least a portion of the cylinder plug.

21. The lock cylinder of claim 18, wherein the means for detecting when at least a portion of the cover deforms and/or separates from the cylinder body includes a continuity circuit.

22. The lock cylinder of claim 21, wherein the continuity circuit is configured to become an open circuit when the cover deforms and/or separates from the cylinder body.

23. The lock cylinder of claim 18, wherein the means for detecting when at least a portion of the cover deforms and/or separates from the cylinder body includes a micro-switch.

24. The lock cylinder of claim 23, wherein the micro-switch contacts a portion of the cylinder plug.

25. The lock cylinder of claim 18, wherein the means for detecting when at least a portion of the cover deforms and/or separates from the cylinder body includes an optical sensor.

26. The lock cylinder of claim 25, wherein the optical sensor includes a light source and a light sensor.

27. The lock cylinder of claim 26, wherein at least a portion of the cylinder plug blocks the light source from the light sensor prior to deformation and/or separation of the cover.

28. The lock cylinder of claim 27, wherein the light sensor detects the light source upon deformation and/or separation of the cover.

29. The lock cylinder of claim 18, wherein the means for detecting when at least a portion of the cover deforms and/or separates from the cylinder body includes a contact microphone.

30. The lock cylinder of claim 18, wherein the means for detecting when at least a portion of the cover deforms and/or separates from the cylinder body includes a sensor assembly, wherein the sensor assembly includes an opening dimensioned to receive the cylinder plug.

31. The lock cylinder of claim 30, wherein the sensor assembly includes a raised edge surrounding the opening.

32. The lock cylinder of claim 31, wherein the sensor assembly includes one or more sensors in the raised edge.

33. The lock cylinder of claim 31, wherein the opening in the sensor assembly is coaxial with an opening in the cylinder body that receives the cylinder plug.

34. The lock cylinder of claim 33, wherein at least a portion of the sensor assembly contacts the cylinder body.

35. A lockset comprising:

an exterior assembly comprising:

a cylinder body;

a cylinder plug disposed in the cylinder body, wherein the cylinder plug is configured to deform and/or separate from the cylinder body when a sufficient force is applied;

a sensor assembly configured to detect deformation and/or separation between at least a portion of the cylinder plug and the cylinder body, the sensor assembly including a base that defines an opening, the opening at least partially surrounding the cylinder plug;

an interior assembly comprising:

an interior driver operatively coupled to the cylinder plug with a torque blade extending there between;

a circuit electrically connected to the sensor assembly; and a tamper lock operative to restrict movement of the interior driver, separate from the cylinder plug;

wherein the circuit is configured to actuate the tamper lock responsive to detection by the sensor assembly that at least a portion of the cylinder plug has deformed and/or separated from the cylinder body.

36. The lockset of claim 35, wherein the circuit is configured to signal an alarm responsive to detection by the sensor assembly that at least a portion of the cylinder plug has deformed and/or separated from the cylinder body.

37. The lockset of claim 35, further comprising a speaker in electrical communication with the circuit, wherein the circuit is configured to actuate an audible alarm with the speaker responsive to detection by the sensor assembly that at least a portion of the cylinder plug has deformed and/or separated from the cylinder body.

38. The lockset of claim 35, further comprising a wireless communication device in electrical communication with the circuit, wherein the circuit is configured to transmit a wireless message with the wireless communication device indicating that the sensor assembly has detected deformation and/or separation of the cylinder plug from the cylinder body.

39. The lockset of claim 35, wherein the tamper lock includes a solenoid with a bolt movable between an extended position and a retracted position, wherein the circuit controls movement of the bolt between the extended and retracted positions.

40. The lockset of claim 39, wherein the interior driver includes an opening into which the bolt of the solenoid is received when in the extended position.

41. A method of detecting tampering with a lock cylinder, the method comprising the steps of:

providing a cylinder body;

providing a cylinder plug disposed in the cylinder body, the cylinder plug having a cover including a keyway, wherein the cover is configured to deform and/or separate from the cylinder body when a sufficient force is applied;

monitoring the cylinder plug to detect deformation and/or separation between at least a portion of the cover and the cylinder body using a sensor assembly positioned between the cover and the cylinder body and including a base that defines an opening, the opening at least partially surrounding the cylinder plug; and responsive to detection of deformation and/or separation between at least a portion of the cover and the cylinder body by the sensor assembly, generating an electrical signal indicating tampering of the cylinder plug.

42. The method of claim 41, further comprising the step of generating an audible alarm responsive to detection that at least a portion of the cover has deformed and/or separated from the cylinder body.

43. The method of claim 41, further comprising the step of actuating a tamper lock that locks the cylinder plug responsive to detection that at least a portion of the cover has deformed and/or separated from the cylinder body.

* * * * *